US008061536B2

(12) United States Patent
Lin et al.

(10) Patent No.: US 8,061,536 B2
(45) **Date of Patent: *Nov. 22, 2011**

(54) TOOL BOX FASTENING DEVICE FOR FASTENING A TOOL BOX SET TO A VERTICAL WALL

(75) Inventors: Pei-Ying Lin, Taichung Hsien (TW); Chanwa Nguy, Cornelius, NC (US)

(73) Assignee: Steelworks Hardware, LLC, Northbrook, IL (US)

( * ) Notice: Subject to any disclaimer, the term of this patent is extended or adjusted under 35 U.S.C. 154(b) by 943 days.

This patent is subject to a terminal disclaimer.

(21) Appl. No.: 10/555,213

(22) PCT Filed: Oct. 26, 2005

(86) PCT No.: PCT/US2005/039398

§ 371 (c)(1),
(2), (4) Date: Oct. 23, 2007

(87) PCT Pub. No.: WO2006/047784

PCT Pub. Date: May 4, 2006

(65) Prior Publication Data

US 2007/0102381 A1 May 10, 2007

(30) Foreign Application Priority Data

Oct. 26, 2004 (TW) ..... 93132335 A

(51) Int. Cl.
*A47F 7/00* (2006.01)

(52) U.S. Cl. ..... 211/70.6; 211/194; 211/163; 206/478; 206/372; 206/373

(58) Field of Classification Search ..... 211/194, 211/70.6, 106, 107, 169.1, 163, 88.01, 133.4, 211/85.23, 205, 97, 103, 165, 169, 78; 206/349, 206/216, 223, 373, 474, 478, 372
See application file for complete search history.

(56) References Cited

U.S. PATENT DOCUMENTS

| | | | | |
|---|---|---|---|---|
| 284,090 | A * | 8/1883 | Tingle | 211/75 |
| 496,173 | A * | 4/1893 | Smith | 211/75 |
| 1,814,740 | A * | 7/1931 | Rapp | 108/183 |
| 2,633,997 | A * | 4/1953 | Johnson | 211/96 |

(Continued)

FOREIGN PATENT DOCUMENTS

DE 19910075 C1 5/2000

(Continued)

OTHER PUBLICATIONS

International Search Report for PCT/US05/039398 dated Jun. 14, 2006.

(Continued)

*Primary Examiner* — Darnell Jayne
*Assistant Examiner* — Devin Barnett
(74) *Attorney, Agent, or Firm* — Levenfeld Pearlstein, LLC

(57) ABSTRACT

Disclosed is a tool box set fastener, which include a first fastening structure, which has mounting base fixedly fastened to a vertical wall or upright support and a coupling unit formed integral with the mounting base, and a second fastening structure, which is connectable to a tool box set to secure the tool box set to the first fastening structure and has a coupling base connectable to the coupling unit of the first fastening structure.

9 Claims, 22 Drawing Sheets

U.S. PATENT DOCUMENTS 2,650,717 A * 9/1953 Larson ..... 211/196
2,692,689 A * 10/1954 Wynne, Sr. ..... 211/165
3,166,286 A * 1/1965 Pfaff ..... 248/263
3,197,034 A * 7/1965 Deadrick ..... 211/205
3,425,658 A * 2/1969 Simmons ..... 249/23
3,498,471 A * 3/1970 Dirkx ..... 211/131.1
3,517,824 A * 6/1970 Paque ..... 211/50
3,635,352 A * 1/1972 Brooks et al. ..... 211/47
3,648,849 A * 3/1972 Harris et al. ..... 211/126.12
3,648,892 A * 3/1972 Morgan ..... 221/301
4,150,464 A * 4/1979 Tracy ..... 24/313
4,239,308 A * 12/1980 Bradley ..... 312/201
4,283,966 A * 8/1981 Hagin ..... 74/572.1
4,399,917 A * 8/1983 Ohman ..... 211/105.2
4,444,324 A * 4/1984 Grenell ..... 215/6
4,546,889 A * 10/1985 Schoumaker et al. ..... 211/105.3
4,712,280 A * 12/1987 Fildan ..... 24/625
4,825,515 A * 5/1989 Wolterstorff, Jr. ..... 24/625
4,901,846 A * 2/1990 Lehman ..... 206/1.8
4,932,391 A 6/1990 Bierdeman
4,991,272 A * 2/1991 Bianchi ..... 24/616
4,999,943 A * 3/1991 Crabtree ..... 43/54.1
5,144,725 A * 9/1992 Krauss ..... 24/625
5,190,251 A 3/1993 Bodo
5,318,189 A * 6/1994 Lee ..... 211/205
5,383,257 A * 1/1995 Krauss ..... 24/625
5,697,507 A * 12/1997 Blass ..... 211/94.01
5,737,810 A * 4/1998 Krauss ..... 24/625
5,746,334 A * 5/1998 Brandenberg ..... 211/205
5,797,568 A 8/1998 Gongora
5,799,787 A * 9/1998 Talbot ..... 206/315.11
5,806,822 A * 9/1998 Schulz ..... 248/309.1
5,944,293 A 8/1999 Loy
5,967,340 A * 10/1999 Kao ..... 211/70.6
5,971,101 A * 10/1999 Taggart ..... 182/129
5,984,441 A * 11/1999 Stokhuijzen ..... 312/240
6,092,656 A * 7/2000 Ernst ..... 206/378
6,158,360 A * 12/2000 Cheng ..... 108/103
6,220,557 B1 4/2001 Ziaylek
6,299,000 B1 * 10/2001 Cabrera ..... 211/70.2
6,425,490 B1 * 7/2002 Ta ..... 211/116
6,431,373 B1 * 8/2002 Blick ..... 211/70.6
D471,358 S * 3/2003 Yang ..... D3/276
D471,359 S * 3/2003 Yang ..... D3/276
6,536,613 B2 * 3/2003 Shea ..... 211/87.01
6,554,235 B1 4/2003 Fortier
6,568,546 B1 * 5/2003 Huang ..... 211/205
6,648,390 B1 * 11/2003 Yang ..... 294/161
6,802,484 B1 10/2004 Kiley
6,834,767 B1 * 12/2004 Lin ..... 211/70.6
6,854,607 B2 * 2/2005 Tong ..... 211/70.6
D505,548 S * 5/2005 Yang ..... D3/282
7,080,733 B2 * 7/2006 Kao ..... 206/372
7,111,368 B2 * 9/2006 Matoba ..... 24/615
D541,612 S * 5/2007 Lin et al. ..... D8/71
7,357,268 B2 * 4/2008 Yang ..... 220/4.26
7,780,017 B2 * 8/2010 Nguy et al. ..... 211/70.6
2003/0001057 A1 1/2003 Sweere
2003/0019775 A1 * 1/2003 Ernst ..... 206/378
2003/0024837 A1 * 2/2003 Chen ..... 206/378
2003/0070999 A1 * 4/2003 Kao ..... 211/70.6
2003/0122048 A1 7/2003 Field
2003/0141211 A1 * 7/2003 Tsai ..... 206/378
2003/0141422 A1 7/2003 Lee et al.
2003/0213760 A1 * 11/2003 Lee ..... 211/70.6
2004/0139812 A1 7/2004 Erel et al.
2004/0188366 A1 * 9/2004 Tong ..... 211/70.6
2004/0211690 A1 * 10/2004 Ho ..... 206/373
2005/0076483 A1 * 4/2005 Chen ..... 24/615
2005/0230335 A1 * 10/2005 Chiu et al. ..... 211/70.6
2007/0163915 A1 * 7/2007 Wu ..... 206/495
2008/0041799 A1 * 2/2008 Nguy et al. ..... 211/70.6
2008/0061020 A1 * 3/2008 Kaisler ..... 211/196
2008/0197131 A1 * 8/2008 Lin et al. ..... 220/23.83
2009/0020489 A1 * 1/2009 Lin et al. ..... 211/88.01
2009/0114783 A1 * 5/2009 Lin et al. ..... 248/200

FOREIGN PATENT DOCUMENTS

EP 824333 2/1998
EP 1520729 A1 4/2005
WO 03037148 5/2003

OTHER PUBLICATIONS

Supplementary Search Report for EP 05 82 0914, Dated Mar. 25, 2009.

* cited by examiner 10
33
30
10
10
33
30
10
10
33
30
10

TOOL BOX FASTENING DEVICE FOR FASTENING A TOOL BOX SET TO A VERTICAL WALL

FIELD OF THE INVENTION

This application claims the benefit of the Republic of China (Taiwan) Application No. 093132335, filed on Oct. 26, 2004.

The present invention relates is a tool box fastening device for fastening a tool box set to a vertical wall or upright support.

DESCRIPTION OF THE RELATED ART

Toolboxes are commonly used for keeping tools, parts and accessories. When several tool boxes are used, the user may directly put the tool boxes and/or tools on the floor and, therefore, the tools may become lost, unorganized, or have a higher incidence of breakage. In order to avoid these problems, the user may attempt to arrange the tool boxes in a set and fasten the tool box set to a vertical wall.

SUMMARY OF THE INVENTION

The present invention overcomes the above problems encountered in the prior art. The instant invention is a tool box fastening device for fastening a tool box set to a vertical wall. The inventor provides a secure means for a tool box set to attach to a vertical wall or upright support. The present invention provides a tool box fastening device for fastening a tool box set to a vertical wall having a reinforced structure to allow for support of a heavy load of tools on a vertical wall or upright support. Furthermore, the present invention provides a tool box fastening device for fastening a tool box set to a vertical wall. The tool box set for attachment to a vertical wall has a first fastening structure. The first fastening structure comprises a mounting base fastened to a vertical support and a coupling unit. A second fastening structure which can be connected to a tool box set The second fastening structure comprises a coupling base connected to a coupling unit of the first fastening structure. The coupling unit of the first fastening structure comprises a center shaft and two locking bars equally spaced from the center shaft at two sides. The coupling base of the second fastening structure is comprised of a hollow member having a plurality of partition walls, a center receiving chamber for receiving the center shaft, and two side receiving chambers separated from the center receiving chamber at two sides by the partition walls for receiving the locking bars. A coupling structure is provided at the mounting base of the first fastening structure so the mounting base of the first fastening structure can be fastened together to hold a plurality of tool box sets at different elevations. The first fastening structures has an end respectively terminating at a back wall of the coupling unit. The back wall of the coupling unit is being formed integrally with the front wall of the mounting base.

DETAILED DESCRIPTION OF THE PREFERRED EMBODIMENT

Figure 1:
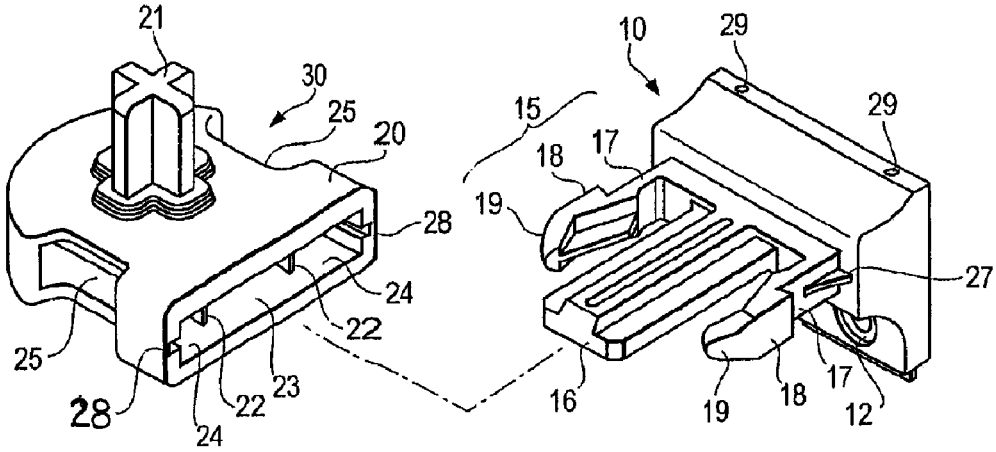
FIG. 1 is an exploded view of a toolbox fastening device for fastening a tool box set to a vertical wall according to the present invention.

A tool box fastening device for fastening a tool box set to a vertical wall comprising: a first fastening structure, said first fastening structure comprising a mounting base fastened to a vertical support, a coupling unit, a second fastening structure, said second fastening structure attachable to a tool box set for securing the tool box set to said first fastening structure. A second fastening structure comprising a coupling base connected to a coupling unit of said first fastening structure. The coupling unit of said first fastening structure comprises a center shaft and a plurality of locking bars.

The coupling unit of said first fastening member comprises a center shaft and two locking bars equally spaced from said center shaft at two sides. The coupling base of said second fastening member is a hollow member having a plurality of partition walls, a center receiving chamber for receiving said center shaft, two side receiving chambers separated from said center receiving chamber at two sides by said partition walls for receiving said locking bars.

Each said locking bar of said first fastening member comprises a front hooked portion, said front hooked portion having a front guide face sloping forwardly inwards toward said center guide shaft The coupling base of said second fastening member has two locking apertures formed in two opposite lateral sidewalls in communication with said side receiving chambers for engagement with the front hooked portions of said locking bars respectively.

The said center shaft and said locking bars of said coupling unit of said first fastening member each having an end respectively terminating at a back wall of said coupling unit, the back wall of said coupling unit being formed integrally with a front wall of said mounting base. The first fastening member further comprises two reinforcing blocks bilaterally connected between the back wall of said coupling unit and the front wall of said mounting base. The coupling base of said second fastening member has two locating grooves respectively formed in said side receiving chambers for receiving said reinforcing blocks of said first fastening member.

The mounting base of said first fastening member comprises two mounting apertures for fastening to said vertical support means with fastening devices.

The mounting base of said first fastening member comprises a coupling structure for enabling two mounting bases of two first fastening members to be fastened together vertically. The coupling structure comprises a tenon and a mortise. The mounting base of said first fastening member has at least one aperture respectively mounted with a wire rod. The wire rod has a length equal to the height of the tool rack set to be fastened.

The tool box fastening device for fastening a tool box set to a vertical wall comprising:

(a) at least one pair of first fastening members respectively fastened to vertical support means at different elevations and aligned in a line, each said first fastening member comprising a mounting base fixedly fastened to said vertical support means and a coupling unit; and (b) at least one pair of second fastening members for securing at least one tool box set to at least one pair of first fastening members, each said second fastening member comprising a coupling base connected to the coupling unit of said first fastening member.

The coupling unit of each said first fastening member comprises a center shaft and two locking bars equally spaced from said center shaft at two sides. The coupling base of each said second fastening member comprises a hollow member having a plurality of partition walls, a center receiving chamber for receiving the center shaft of one said first fastening member, two side receiving chambers separated from said center for a receiving chamber at two sides by said partition walls for receiving the locking bars of one said first fastening member.

Each locking bar of each said first fastening member comprises a front hooked portion, said front hooked portion having a front guide face sloping forwardly inwards toward said center guide shaft. The coupling base of each said second fastening member has two locking apertures formed in two opposite lateral sidewalls thereof in communication with said side receiving chambers for engagement with the front hooked portions of the locking bars of one said first fastening member respectively. The said center shaft and said locking bars of said coupling unit of each said first fastening member each have an end terminating at a back wall of said coupling unit The back wall of said coupling unit being formed integrally with a front wall of said mounting base. The first fastening member further comprises two reinforcing blocks bilaterally connected between the back wall of said coupling unit and the front wall of said mounting base. The coupling base of each said second fastening member has two locating grooves respectively formed in said side receiving chambers for receiving said reinforcing blocks of a first fastening member. The mounting base of each said first fastening member comprises two mounting apertures for fastening to a vertical support means with fasting devices. The mounting base of each said first fastening member comprises a coupling structure for enabling two mounting bases of two first fastening members to be fastened together. The coupling structure comprises a tenon and a mortise. The mounting base of each said first fastening member has at least one aperture respectively mounted with a wire rod. The wire rod has a length equal to the height of the tool rack set to be fastened.

A toolbox fastening device for fastening a toolbox set to a vertical wall further comprises a plurality of first connectors fixedly fastened to a vertical wall at different elevations and vertically or horizontally aligned, plurality of second connectors connected to said first connectors for holding a toolbox set The second connectors each having a plug rod for mounting. A plurality of coupling units for attachment of said first connectors with said second connectors for fastening said second connectors to said first connectors. A plurality of end caps respectively provided at the two ends. The hollow upright pivot shaft of a toolbox set for receiving said second connectors to secure said second connectors to the ends of the hollow upright pivot shaft of the toolbox set having end caps each having a slot for receiving a plug rod for one of the second connectors; and a plurality of locking members respectively transversely mounted in said end caps and respectively transposed and attached relative to the slot of the respective end caps between a second position where the slot of the end cap is opened for the insertion of the plug rod of one of said second connector and a first position where the respective locking member engages the plug rod of the respective second connector to lock the respective second connector to the respective end cap.

The end caps each comprise a cup-like head, and a cylindrical shank formed integral with and axially extending from said cup-like head. The cup-like head having a head wall, which defines the slot of the respective end cap. The locking members each comprise two parallel locking rods inserted into the cup-like head of one of said end caps. The locking rods each have a retaining block disposed at an inner side adapted to lock the plug rod of one of said second connectors in the slot of one of said end caps. A handle is connected to said locking rods at one end and is positioned outside the cup-like head of the end cap for pushing by the user to move the respective locking member from said first position to said second position. Spring devices are provided which are adapted to support the respective locking member in the first position.

The spring device extends from the handle and is positioned against the periphery of the cylindrical shank of the respective end cap to support the respective locking member in the first position.

The spring device comprises two smoothly arched spring rods respectively extending from said handle in a direction toward each other and respectively positioned against the periphery of the cylindrical shank of the respective end cap.

The locking rods each have a free end terminating in a hooked tip attached on the periphery of the cylindrical shank of the respective end cap.

A retaining block of each of said locking rod has a beveled face facing the head wall of the cup-like head of the respective end cap. The head wall of the cup-like head of each of said end cap has two grooves adapted to receive the locking rods of the respective locking member.

The plug rod of each second connector has a neck The training block of each of the two locking rods of each of said locking members is forced into engagement with the neck of the plug rod of the respective second connector when the respective locking member is moved to said first position.

The retaining block of each of the two locking rods of each of said locking member is disengaged from the neck of the plug rod of the respective second connector when the respective locking member is moved to a second position. The axial length of the cylindrical shank of each end cap is longer than the cup-like head of the respective end cap so the cylindrical shank of each of said end cap has a lower part protruding over a bottom side of the cup-like head of the respective end cap and connected to one end of the pivot shaft of a toolbox set.

The cylindrical shaft of each of said end cap has a locating groove transversely disposed at the periphery, and a bottom open side extending from one end of said locating groove to a bottom edge of the cylindrical shank of the respective end cap for guiding a retaining block of the hollow upright pivot shaft of a toolbox set into said locating groove for enabling the retaining block of the hollow upright pivot shaft of the toolbox set to be engaged with said locating groove after rotation of the cylindrical shaft with the respective end cap through an angle relative to the hollow upright pivot shaft of the toolbox set.

Each end cap comprises a cup-like head. Each cup-like head having a head wall defining a slot for the respective end cap for the insertion of the plug rod of one of said second connectors, an inside flange perpendicularly extends from said head wall around the slot, and two inner openings respectively formed in said inside flange at two opposite lateral sides. Locking members comprise a handle extending out of the cup-like head of the respective end cap for positioning by the user to move the respective locking member to a second position. A locking ring extends from said handle and is coupled to the inside flange of the respective end cap. The locking ring has two retaining blocks disposed at two sides corresponding to said two inner openings for engaging the plug rod of the respective second connector being inserted into the slot of the respective end cap, and a spring device adapted to support the respective locking member is in a first position.

The spring device is connected between the locating ring of the respective locking member and an inside wall of the cup-like head of the respective end cap. The spring device comprises two smoothly arched spring rods forwardly extending from a locating ring of the respective locking member in a direction toward each other and respectively positioned against an inside wall of the cup-like head of the respective end cap.

The cup-like head of each end cap has a plurality of axially extending crevices in the periphery thereof.

The cup-like head of each end cap has at least one retaining block for engaging a retaining aperture in one end of the hollow upright pivot shaft of a toolbox set. The retaining blocks of the locating ring of each locking member have a beveled face in communication with the head wall of the cup-like end cap.

The plug rod of each second connector has a neck. The retaining blocks of the locating ring of each of said locking member are forcibly engaged with the neck of the plug rod of the respective second connector when the respective locking member is in a first position.

The retaining blocks of the locating ring of each of said locking member are disengaged from the neck of the plug rod of the respective second connector when the respective locking member is in a second position.

Each end cap comprises a hollow shell, a plug axially mounted in and rotatable relative to said hollow shell, and a cover fastened to said hollow shell, said cover having a center aperture for the passing of the plug rod of one of said second connector into the slot of the respective end cap. The slot of each end cap is defined in the plug of the respective end cap. Locking members are respectively supported in between the plug and cover of each end cap, each locking member comprising a handle suspended outside the hollow shell of the respective end cap, a locating ring extended from said handle and elastically deformable and is adapted to engage the plug rod of one of the second connectors. A spring device is provided which is connected between said hollow shell and the respective locking member to support the respective locking member in said first position. The spring device of each of said locking members is connected between the locating ring of the respective locking member and an inside wall of the respective end cap.

The spring device of each of said locking members is comprised of two smoothly arched spring rods forwardly extending from the locating ring of the respective locking member in direction toward each other and stopped against an inside wall of the hollow shell of the respective end cap. The cover of each end cap comprises a first stop flange and a second stop flange. The locating ring of each of said locking members is coupled to the first stop flange of the respective end cap. The two spring rods of the spring device of each of said locking members surround the second stop flange of the respective end cap.

The plug rod of each of said second connectors has a neck. The locating ring of each of said locking members is forcibly engaged with the neck of the plug rod of the respective second connector when the respective locking member is in said first position.

The locating ring of each of said locking members is disengaged from the neck of the plug rod of the respective second connectors when the respective locking member is moved to said second position. The hollow shell of each end cap comprises a chamber, said chamber having a polygonal cross section, a step formed in an inside wall inside said chamber, a polygonal locating plate supported on said step inside said chamber, a plug of each end cap comprises a head supported on said polygonal locating plate below the cover, and the respective hollow upright pivot shaft for connecting the device to receive the plug rod of one of said second connectors, and a shank extending from said head and inserted through said polygonal locating plate. The slot of each end cap is axially defined in the head of the plug of the respective end cap.

The hollow shell of each end cap further comprises a coupling ring axially extending from said step, having two retaining apertures formed in the coupling ring at two opposite sides. The polygonal locating plate has two border notches disposed at two opposite sides. The cover of each end cap comprises two coupling plates, said coupling plates each have a hooked portion for the retaining apertures of the coupling ring of the hollow shell of the respective end cap.

The hollow shell of each end cap further comprises a plurality of hooks for retaining apertures at one end of the hollow upright pivot shaft of a toolbox set. The locating ring of each of said locking members has two beveled faces symmetrically disposed at two opposite lateral sides opposing each other. The coupling units include a plurality of first coupling units and a plurality of second coupling units respectively provided at said first connectors and said second connectors. Said first coupling units each comprising a center coupling element and two side coupling elements at two sides of said center coupling element. Said second coupling units each comprising a center insertion aperture adapted to receive the center coupling element of one of said first coupling units respectively, and a plurality of partition walls that separate said center insertion aperture and said side insertion apertures from one another.

The side coupling elements of each of said first coupling units are elastically deformable, each comprising an outwardly protruding front retaining block, said outwardly protruding front retaining block having a sloping guide face. The second coupling units each comprise two side retaining apertures respectively disposed in communication with the respective side insertion apertures and adapted to receive the outwardly protruding front retaining blocks of the two side coupling elements of one of said first coupling units to secure the respective first coupling unit to the respective second coupling unit.

The first coupling units comprise a solid connecting portion formed integrally with one end of a center coupling element and the side coupling elements of the respective first coupling unit.

The first coupling units each further comprise two reinforcing blocks disposed at two opposite sides; said second coupling units each comprise two locating grooves adapted to receive the reinforcing blocks of the respective first coupling unit.

The first connectors each comprise a plurality of mounting apertures fixedly fastened to a vertical wall with a respective fastening member. The first connectors each further comprise a coupling structure for allowing a plurality of said first connectors to be coupled together.

The coupling structure of each of said first connectors comprise a tongue and a groove. The tongue of the coupling structure of one of said first connectors being detachably connected to the groove of the coupling structure of another one of said first connectors.

The first connectors each further comprise at least one mounting aperture for the connection of a connecting wire rod to connect two of said first connectors.

The connecting wire rod has a length equal to the hollow upright pivot shaft of the toolbox set to be fastened.

The toolbox fastening device for fastening a toolbox set to a vertical wall, comprises a plurality of first connectors fixedly fastened to a wall at different elevations and aligned in a line. A plurality of second connectors respectively connected to said first connectors to hold a toolbox set, said second connectors each having a plug rod for mounting, said plug rod having a neck; a plurality of coupling units respectively provided at said first connectors and said second connectors for fastening said second connectors to said first connectors; a plurality of end caps respectively provided at the two distal ends of the hollow upright pivot shaft of a toolbox set for receiving said second connectors to secure said second connectors to the ends of the hollow upright pivot shaft of the toolbox set, said end caps each having a slot for receiving the plug rod of one of said second connectors; and a plurality of locking members respectively transversely mounted in said end caps and respectively moveable relative to the slot of the respective end cap between a second position where the slot of the respective end cap is opened for the insertion of the plug rod of one of said second connectors and a first position where the respective locking member engages the neck of the plug rod of the respective second connector to lock the respective second connector to the respective end cap. The locking members each comprising a handle suspending outside the respective end cap for positioning by the user to move the respective locking member from said first position to said second position. A plug rod engagement means extended from said handle and adapted to engage the neck of the plug rod of one of said second connector when the respective locking member is moved to said first position, and a spring device adapted to support the respective locking member in said first position.

Each end cap comprises a cup-like head, and a cylindrical shank formed integrally with and axially extending from said cup-like head, said cup-like head having a head wall which defines the slot of the respective end cap, the plug rod engagement means of each of said locking members comprises two parallel locking rods forwardly extended from the handle of the respective locking member and inserted into the cup-like head of one of said pivot shaft connecting devices, said locking rods each having a retaining block disposed at an inner side adapted to engage the neck of the plug rod of one of said second connectors being inserted into the slot of one end cap; the spring device of each of said locking members is connected between the handle of the respective locking member and the periphery of the cylindrical shank of the respective end cap.

The spring device comprises two smoothly arched spring rods respectively extending from said handle in direction toward each other and respectively stopped against the periphery of the cylindrical shank of the respective hollow upright pivot shaft connecting device. The locking rods each have a free end terminating in a hooked tip respectively hooked on the periphery of the cylindrical shank of the respective end cap. The retaining block of each of said locking rods has a beveled face facing the head wall of the cup-like head of the respective end cap.

The head wall of the cup-like head of each end cap has two grooves adapted to receive the locking rods of the respective locking member.

The axial length of the cylindrical shank of each end cap is longer than the cup-like head of the respective end cap so that the cylindrical shank of each of said end cap has a lower part protruding over a bottom side of the cup-like head of the respective end cap and connected to an end of the hollow upright pivot shaft of a toolbox set.

The cylindrical shaft of each end cap having an allocating groove transversely disposed at the periphery thereof, and a bottom open side extending from one end of said locating groove to a bottom edge of the cylindrical shank of the respective end cap for guiding a retaining block of the hollow upright pivot shaft of a toolbox set into said locating groove for enabling the retaining block of the hollow upright pivot shaft of the toolbox set to be engaged with said locating groove after rotation of the cylindrical shaft with the respective end cap through an angle relative to the hollow upright pivot shaft of the toolbox set.

The cup-like head of each end cap is provided with a carrying handle. Each end cap comprises a cup-like head, said cup-like head having a head wall defining the slot of the respective end cap for the insertion of the plug rod of one of said second connectors, an inside flange perpendicularly extended from said head wall around the slot, and two inner openings respectively formed in the inside flange at two opposite lateral sides, the plug rod engagement means of each of said locking members comprises a locating ring extended from the handle of the respective locking member and coupled to the inside flange of the respective end cap, said locating ring having two retaining blocks disposed at two sides corresponding to said two inner openings for engaging the neck of the plug rod of the respective second connector being inserted into the slot of the respective end cap, the spring device of each of said locking member is connected between the locating ring of the respective locking member and an inside wall of the cup-like head of the respective end cap.

The spring device comprises two smoothly arched spring rods extending from the locating ring of the respective locking member in direction toward each other and respectively stopped against an inside wall of the cup-like head of the respective end cap. The cup-like head of each end cap has a plurality of axially extending crevices in the periphery thereof.

The cup-like head of each end cap has at least one retaining block for engagement into a respective retaining aperture in one end of the hollow upright pivot shaft of a toolbox set.

The retaining blocks of the locating ring of each of said locking member each have a beveled face facing the head wall of the cup-like head of the respective end cap. Each end cap comprises a hollow shell, a plug axially mounted in and rotatable relative to said hollow shell, and a cover fastened to said hollow shell, said cover having a center through aperture for the passing of the plug rod of one of said second connectors into the slot of the respective end cap; the slot of each of said cap is defined in the plug of the respective end cap; said locking members are respectively supported in between the plug and cover of each end cap; the plug rod engagement portion of each of said locking member comprises a locating ring extended from the handle of the respective locking member and elastically deformable and adapted to engage the neck of the plug rod of one of said second connector after insertion of the plug rod of one of said second connector into the slot of the respective end cap; the spring device of each of said locking member is connected between the locating ring of the respective locking member and an inside wall of the hollow shell of the respective end cap.

The spring device of each of said locking members is comprised of two smoothly arched spring rods extending from the locating ring of the respective locking member in a direction toward each other and positioned against an inside wall of the hollow shell of the respective end cap.

The cover of each end cap comprises a first stop flange and a second stop flange; the locating ring of each of said locking members is coupled to the first stop flange of the respective end cap; the two spring rods of the spring device of each of said locking member surrounds the second stop flange of the respective end cap. The hollow shell of each end cap comprises a chamber, said chamber having a polygonal cross section, a stop formed in an inside wall thereof inside said chamber, a polygonal locating plate supported on said step inside said chamber, the plug of each of said end cap comprises a head supported on said polygonal locating plate below the cover of the respective hollow upright pivot shaft connecting device for receiving the plug rod of one of said second connectors, and a shank extending from said head and inserted through said polygonal locating plate; the slot each of said end caps is axially defined in the head of the plug of the end cap. The hollow shell of each end cap further comprises a coupling ring at two opposite sides; said polygonal locating plate has two border notches disposed at two opposite sides; the cover of each end cap comprises two coupling plates, said coupling plates each having a hooked portion respectively hooked in the retaining apertures of the coupling ring of the hollow shell of the respective end cap.

The hollow shell of each end cap further comprises a plurality of hooks for retaining apertures at one end of the hollow upright pivot shaft of a toolbox set. The locating ring of each of said locking members has two beveled faces symmetrically disposed at two opposite lateral sides opposing each other. The coupling units include a plurality of first coupling units and a plurality of second coupling units respectively provided at said first connectors and said second connectors, said first coupling units each comprising a center coupling element and two side coupling elements at two sides of said center coupling element, said second coupling units each comprising a center insertion aperture adapted to receive the center coupling element of one of said first coupling units, two side insertion apertures adapted to receive the side coupling elements of one of said first coupling units respectively, and a plurality of partition walls that separate said center insertion aperture and said side insertion aperture from one another. The side coupling elements of each of said first coupling units are elastically deformable, each comprising an outwardly protruding front retaining block, said outwardly protruding front retaining block having a sloping guide face, said second coupling units each further comprise two side retaining apertures respectively disposed in communication with the respective side insertion apertures and adapted to receive the outwardly protruding front retaining blocks of the two side coupling elements of one of said first coupling units to secure the respective first coupling unit to the respective second coupling unit The first coupling units each further comprise a solid connecting portion formed integrally with one end of each of the center coupling elements and side coupling elements of the respective first coupling unit. The first coupling units each further comprise two reinforcing blocks disposed at two opposite sides of the respective solid connecting portion; said second coupling units each further comprise two locating grooves adapted to receive the reinforcing blocks of the respective first coupling unit. The first connectors each comprise a plurality of mounting apertures fixedly fastened to a vertical wall with a respective fastening member. The first connectors each further comprise a coupling structure for allowing two of said first connectors to be coupled together. The coupling structure of each of said first connectors comprise a tongue and a groove. The tongue of the coupling structure of one of said first connectors being connectable to the groove of the coupling structure of another one of said first connectors. The first connectors each further comprise at least one mounting aperture for a connecting wire rod to connect two of said first connectors. The connecting wire rod has a length equal to the hollow upright pivot shaft of the toolbox set to be fastened.

The toolbox fastening device for fastening a toolbox set to a wall comprising two first connectors fixedly fastened to a wall at different elevations and aligned in a line. Two second connectors respectively connected to said first connectors to hold a toolbox set. Said second connectors each having a plug rod for mounting, and two connecting structures adapted to detachably connect the plug rod of each of said second connectors to the two ends of the hollow upright pivot shaft of a toolbox set, said connecting structures each comprising an end cap provided at one end of the hollow upright pivot shaft of a toolbox set for receiving one of said second connectors to secure the respective second connector to the hollow upright pivot shaft of the toolbox set. An end cap comprising a cup-like head and a cylindrical shank formed integrally with and axially extending from said cup-like head, said cup-like head having a head wall and a slot defined in said head wall for receiving the plug rod of said end cap. A locking member transversely mounted in the end cap and respectively positionable relative to the slot of the respective end cap between a second position where the slot of said end cap is opened for the insertion of the plug rod of one of said second connectors and a first position where said locking member engages the plug rod of the respective second connector to lock the respective second connector to said end cap. The locking member comprising a handle suspending outside said end cap for positioning by the user to move said locking member from said first position to said second position, and two locking rods respectively extending from said handle, said locking rods each having a retaining block for engaging the plug rod of one of said second connectors, and a spring device connected between said locking member and the cup-like head of said end cap to support said locking member in said first position. The spring devices are connected between the handle of said locking member and the periphery of the cylindrical shank of said end cap.

The spring device comprises two smoothly arched spring rods respectively extending from said handle in direction toward each other and respectively stopped against the periphery of the cylindrical shank of said end cap. The locking rods each have a free end terminating in a hooked tip respectively hooked on the periphery of the cylindrical shank of said end cap. The retaining block of each of said locking rods has a beveled face facing the head wall of the cup-like head of said end cap.

The head wall of the cup-like head of each of said end cap has two grooves adapted to receive the locking rods of said locking member. The plug rod of each of said second connectors has a neck.

The retaining block of each of said two locking rods of said locking member is forced into engagement with the neck of the plug rod of the respective second connector when said locking member is moved to said first position. The retaining block of each of said two locking rods of said locking member is disengaged from the neck of the plug rod of the respective second connector when said locking member is moved to said second position. The axial length of the cylindrical shank of said end cap is longer than the cup-like head of said end cap. The cylindrical shank of said end having a lower part protruding over a bottom side of the cup-like head of said end cap and connected to one end of the pivot shaft of a toolbox set. The cylindrical shaft of said end cap has a locating groove transversely disposed at the periphery thereof, and a bottom open side extending from one end of said locating groove to a bottom edge of the cylindrical shank of said end cap for guiding a retaining block of the hollow upright pivot shaft of a toolbox set into said locating groove for enabling the retaining block of the hollow upright pivot shaft of the toolbox set to be engaged with said locating groove after rotation of the hollow upright pivot shaft with said end cap through an angle relative to the hollow upright pivot shaft of the toolbox set The cup-like head of said pivot shaft connecting device is provided with a carrying handle.

The toolbox fastening device for fastening a toolbox set to a wall comprising two first connectors fixedly fastened to a wall at different elevations and aligned, two second connectors respectively connected to said first connectors to hold a toolbox set, said second connectors each having a plug rod for mounting, and two connecting structures adapted to detachably connect the plug rod of each of said second connectors to the two ends of the hollow upright pivot shaft of a toolbox set, said connecting structures each comprising an end cap provided at one end of the hollow upright pivot shaft of a toolbox set, said end cap comprising a cup-like head, said cup-like head having a head wall defining a slot for the insertion of the plug rod of one of said second connectors, an inside flange perpendicularly extended from said head wall around said slot, and two inner openings respectively formed in said inside flange at two opposite lateral sides; a locking member transversely mounted in said end cap and moveable relative to the slot of said end cap between a second position where the slot of said end cap between a second position where the slot of said end cap is opened for the insertion of the plug rod of one of said second connectors and a first position where said locking members engages the plug rod of the respective second connector to lock the respective second connector to said end cap, said locking member comprising a handle suspended outside said cup-like head of said end cap for positioning by the user to move said locking member, a locating ring extended from said handle and coupled to the inside flange of said end cap, said locating ring having two retaining blocks disposed at two sides corresponding to said two inner openings for engaging a plug rod of the respective second connector being inserted into the slot of said end cap; and a spring device connected between said locking member and the cup-like head of said end cap to support said locking member in said first position.

The spring device is connected between the locating ring of said locking member and an inside wall of the cup-like head of said hollow upright pivot shaft connecting device. The spring device comprises a plurality smoothly arched spring rods respectively extending from said handle in a direction toward each other and respectively stopped against an inside wall of said cup-like head of said end cap. The cup-like head of said end cap has a plurality of crevices axially extending in the periphery thereof. The cup-like head of said end cap has at least one retaining block for engaging into a respective retaining aperture in one end of the hollow upright pivot shaft of a toolbox set The retaining blocks of the locating ring of said locking member each have a beveled face facing the head wall of the cup-like end cap. The plug rod of each of said second connector has a neck. The retaining blocks of the locking ring of said locking member are forced into engagement with the neck of the plug rod of one of said second connectors when said locking member is moved to said first position. The retaining blocks of the locking ring of said locking member are disengaged from the neck of the plug rod of the respective second connector when said locking member is moved to said second position.

The toolbox fastening device for fastening a toolbox set to a vertical wall comprises two first connectors fixedly fastened to a vertical wall at different elevations and vertically aligned in a line, two second connectors connected to said first connectors to hold a toolbox set, said second connectors each having a plug rod for mounting, and two connecting structures adapted to detachably connect the plug rod of each of said second connectors to the two ends of the hollow upright pivot shaft of a toolbox set, said connecting structures each comprising an end cap provided at one end of the hollow upright pivot shaft of a toolbox set for receiving one of said second connectors to secure the respective second connector to the hollow upright pivot shaft of the toolbox set, said end cap comprising a hollow shell, a plug axially mounted in and rotatable relative to said hollow shell, said plug defining a slot for the connection of the plug rod of one of said second connectors, and a cover fastened to said hollow shell, said cover having a center through aperture for the passing of the plug rod of one of said second connectors into the slot of said plug. A locking member transversely mounted in said end cap and movable relative to said end cap between a second position where the slot of said end cap is opened for the insertion of the plug rod of one of said second connectors and a first position where said locking member engages the plug rod of the respective second connector to lock the respective second connector to said end cap, said locking member comprising a handle suspended outside said cup-like head of said end cap for pushing by the user to move said locking member, and a locating ring extended from said handle and adapted to engage the plug rod of one of said second connectors; and a spring device connected between said locking member and said hollow shell of said end cap to support said locking member in said first position.

The spring device is connected between the locating ring of said locking member and an inside wall of hollow shell of said end cap.

The spring device comprises two smoothly arched spring rods respectively extending from said locating in direction toward each other and respectively stopped against an inside wall of said hollow shell of said end cap. The cover of said pivot shaft connecting device comprises a first stop flange and a second stop flange; the locating ring of said locking members is coupled to the first stop flange of said pivot shaft connecting device; the two spring rods of said spring device surround the second stop flange of said pivot shaft connecting device. The plug rod of each of said second connectors has a neck. The locating ring of said locking members is forcibly into engagement with the neck of the plug rod of the respective second connector when said locking member is moved to said first position. The locating ring of said locking members is disengaged from the neck of the plug rod of the respective second connector when said locking member is moved to said second position.

The hollow shell of said end cap comprises a chamber, said chamber having a polygonal cross section, a step formed in an inside wall thereof inside said chamber, a polygonal locating plate supported on said step inside said chamber, the plug of said end cap comprises a head supported on said polygonal locating plate below the cover of said end cap for receiving the plug rod of one of said second connectors, and a shank extending form said head and inserted through said polygonal locating plate; the slot of said end cap is axially defined in the head of the plug of the respective end cap. The hollow shell of said end cap further comprises a coupling ring axially extending form said step, and two retaining apertures formed in said coupling ring at two opposite sides; said polygonal locating plate has two border notches disposed at two opposite sides, the cover of said end cap comprises two coupling walls, said coupling walls each having a hooked portion respectively hooked in the retaining apertures at one end of the hollow upright pivot shaft of a toolbox set. The locating ring of said locking member has two beveled faces symmetrically disposed at two opposite lateral sides opposing each other.

The toolbox fastening device for fastening a toolbox set to a vertical wall comprising:

(a) a first connector fixedly fastened to a wall;

(b) a second connector connectable to said first connector to hold a toolbox set, and two coupling units respectively provided at said first connector and said second connector to said first connector.

The coupling units include a first coupling unit and a second coupling unit respectively provided at said first connector and said second connector, said first coupling unit comprising a center coupling element and two side coupling elements at two sides of said center coupling element, said second coupling units comprising a center insertion aperture adapted to receive the center coupling element of said first coupling unit, two side insertion apertures adapted to receive the side coupling elements of said first coupling unit respectively, and a plurality of partition walls that separate said center insertion aperture and said side insertion aperture. The side coupling elements of said first coupling elements of said first coupling units are elastically deformable each comprising an outwardly protruding front retaining block, said outwardly protruding front retaining block having a sloping guide face, said second coupling unit further comprise two side retaining apertures respectively disposed in communication with said side insertion apertures and adapted to receive the outwardly protruding front retaining and adapted to receive the outwardly protruding front retaining blocks of the two side coupling elements of said first coupling unit to secure said first coupling unit to said second coupling unit. The fist coupling unit further comprises a solid connecting portion formed integral with one end of each of the center coupling element and side coupling elements of said first coupling unit. The first coupling unit further comprises two reinforcing blocks disposed at two opposite sides of said solid connecting portion; said second coupling unit further comprises two locating grooves adapted to receive the reinforcing blocks of said first coupling unit. The first connector comprises a plurality of mounting apertures fixedly fastened to a wall with a fastening member. The first connector further comprises a coupling structure for allowing two first connectors to be coupled together. The coupling structure of said first connector comprises a tongue and groove. The tongue of the coupling structure of one first connector being connectable to the groove of the coupling structure of another first connector. The first connector further comprises at least one mounting aperture for the connector of a connecting wire rod to connect to first connectors. The connecting wire rod has a length equal to the pivot shaft of the toolbox set to be fastened.

DETAILED DESCRIPTION OF THE FIGURES

Figure 2:
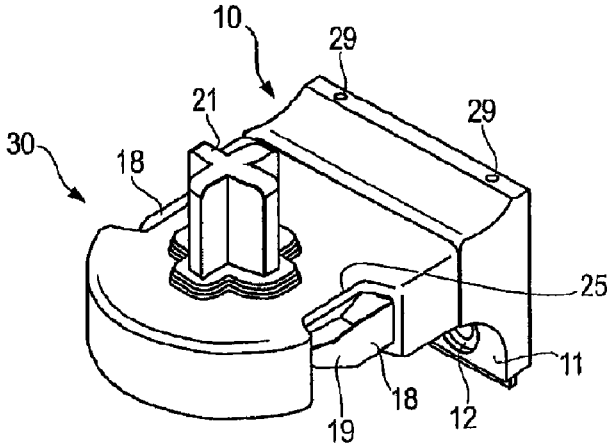
FIG. 2 is a perspective view of the assembly of the fastening device of a tool box set to a vertical wall according to the present invention.
Figure 3:
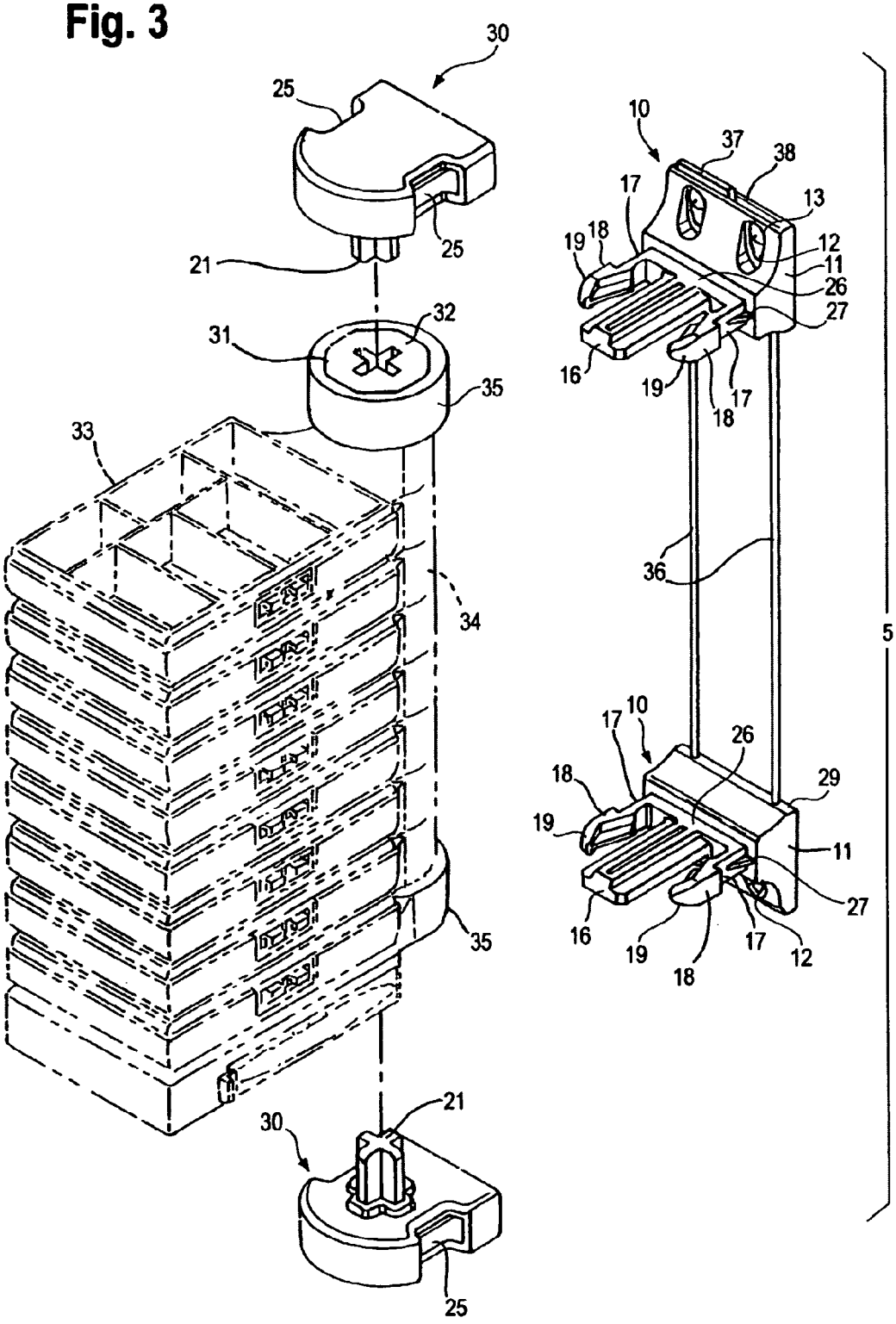
FIG. 3 is an exploded view showing one application example of the present invention.

FIGS. 1, 2 and 3 illustrate a toolbox fastening device for fastening a toolbox set (33) to a wall in accordance with the present invention comprising a first fastening structure (10) and a second fastening structure (30) detachably fastened together for securing a toolbox set (33) to a wall or upright support The first fastening structure (10) comprises a mounting base (11) for fastening to a wall or upright support, and a coupling unit (15) detachably connectable to the second fastening structure (30). The mounting base (11) has a plurality of mounting apertures, for example, countersunk apertures (12) for the mounting of a fastening structure, such as, screws (13) to affix the first fastening structure (10) to a wall of the mounting base (11), comprises a center guide shaft (16) and a plurality of spring locking bars (17) equally spaced from the center guide shaft (16) at two sides. Each spring locking bar (17) has a front hooked portion (18). The front hooked portion (18) has a front guide face (19) sloping forwardly inwards toward the center guide shaft (16).

The second fastening structure (30) comprises a coupling base (20) adapted to receive the coupling unit (15) of the first fastening structure (10) and a plug rod (21) for fastening a toolbox set (33). The coupling base (31) is a hollow member having the inside space separated by partition walls (32) into a center receiving chamber (23) and two side receiving chambers (24) for receiving the center guide shaft (16) and locking bars (17) of the first fastening structure (10) respectively, and two locking apertures (25) formed in the two opposite lateral sidewalls in communication with the side receiving chambers (24) for engagement with the front hooked portions (18) of the locking bars (17) of the first fastening structure (10). By means of the guide of the front guide face (19) of each of the locking bars (17) the locking bars (17) of the first fastening structure (10) can be easily guided into the side receiving chambers (24) of the second fastening structure (30) to force the front hooked portion (18) of each of the locking bars (17) into engagement with the locking apertures (25) of the second fastening structure (30). Further, when releasing the second fastening structure (30) from the first fastening structure (10), the user can squeeze or pinch the front hooked portions (18) of the two locking bars (17) inwards toward the inside of the coupling base (20) of the second fastening structure (30) to disengage the locking apertures (25) from the locking bars (17).

The coupling unit (15) has a back wall (26) formed integrally with the front wall of the mounting base (11), and a plurality of triangular reinforcing blocks (27) connected between two sides of the back wall (26) and the front wall of the mounting base (11) to reinforce the structural strength of the back wall (26) against the load after installation of the toolbox set fastener to secure the toolbox set (33) to a wall or upright support. The coupling base (20) has a plurality of locating grooves (28) respectively disposed inside the side receiving chambers (24) for receiving the triangular reinforcing blocks (27) upon insertion of the locking bars (17) into the side receiving chambers (24). Further, the partition walls (22) serve as reinforcing means to reinforce the structural strength of the second fastening structure (30) and apertures through which wire rods may be optionally drawn (36).

Figure 4:
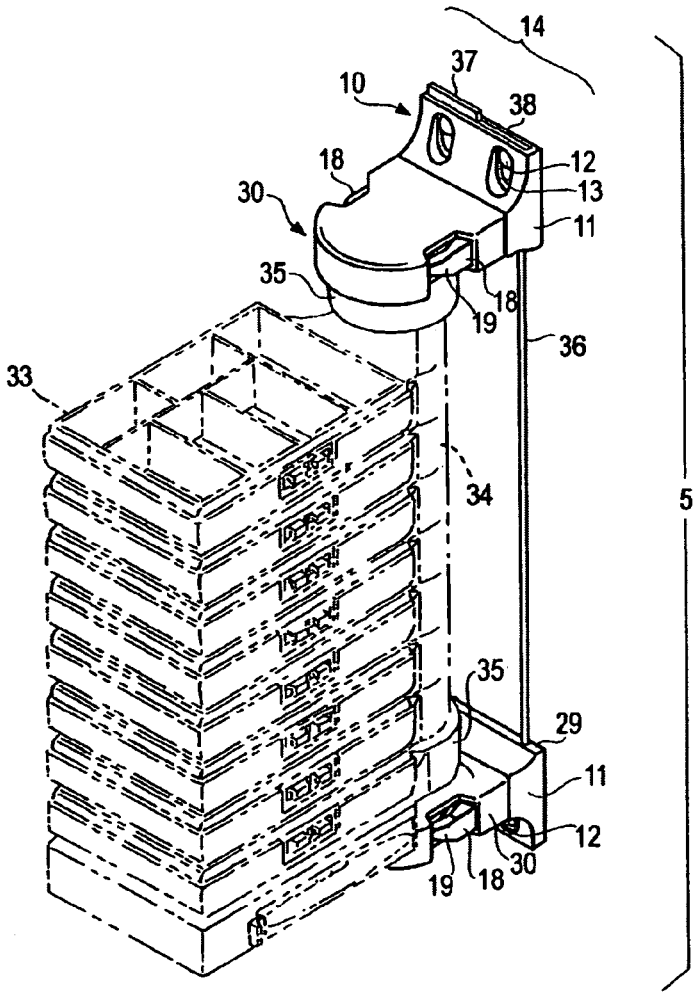
FIG. 4 is an assembly view of FIG. 3.

FIGS. 3 and 4 illustrate the toolbox set (33) comprising a hollow upright pivot shaft (34) and two end caps (35) respectively capped on the top and bottom ends of the hollow upright pivot shaft (34). Each end cap (35) has a coupling wall (31) and a plughole (32) formed in the coupling wall (31) for receiving the plug rod (21) of the second fastening structure (30). A plurality of toolbox set fasteners are used and respectively fastened to the plug apertures (37) of the two end caps (35) of the toolbox set (33) to secure the toolbox set to a wall or upright support, Further, two wire rods (36) may be used to hold a plurality of toolbox fasteners together for quick installation. Usually, the wire has a length equal to the heights of the toolbox set to be fastened. The mounting base (11) of the first fastening structure has a plurality of parallel apertures (29) extending through the top and bottom sides thereof for receiving the wire rods (36). The diameter of the apertures (29) is equal to or greater than the diameter of the wire rods (36). After insertion of the wire rods (36) into the apertures (25) of the mounting base (11) of each toolbox set fastener (33), a plurality of toolbox set fasteners (33) can be moved along the wire rods (3) to fit the size of the toolbox set (33).

FIG. 3 shows the toolbox fastening device (5) for fastening a toolbox set (33) to a wall. FIGS. 3 and 4 also are shown a second fastening structure (30), a plughole (21), two locking apertures of the second fastening structure (20), a coupling wall (31) a plughole (21) formed in the coupling wall (31), a coupling structure (14) which comprises a tenon (37) and a mortise (38), the first coupling structure (10), a coupling unit (15) detachably connected to the second fastening structure (30), two spring locking bars (17), including the front hooked portion (18) which the user can position and a front guide face (19) in front of the hooked portion (18). FIGS. 3 and 4 show a guide shaft (16), a plurality of reinforcing hooks (27) and a plurality of apertures (12) located in the mounting base (11).

FIGS. 5, 6, 7 and 8 show the mounting base (11) has a coupling structure (14), which comprises a tenon (37) and a mortise (38). By means of fastening the tenon (37) of the first fastening structure (10) of one toolbox set fastener (33) to the mortise (38) of the first fastening structure (10) of another toolbox set fastener (33) a plurality of toolbox set fasteners (33) are fastened together. Therefore, the instant invention can be used to fasten a number of toolbox sets (33) to a wall or upright support at different elevations. The first fastening structure (10) and the second fastening structure (30), and the partition walls (22) support the second fastening structure (30) against deformation. These features directly or indirectly help the first fastening structure (10) to bear the load and facilitate fastening the toolbox set to the wall.

Figure 5:
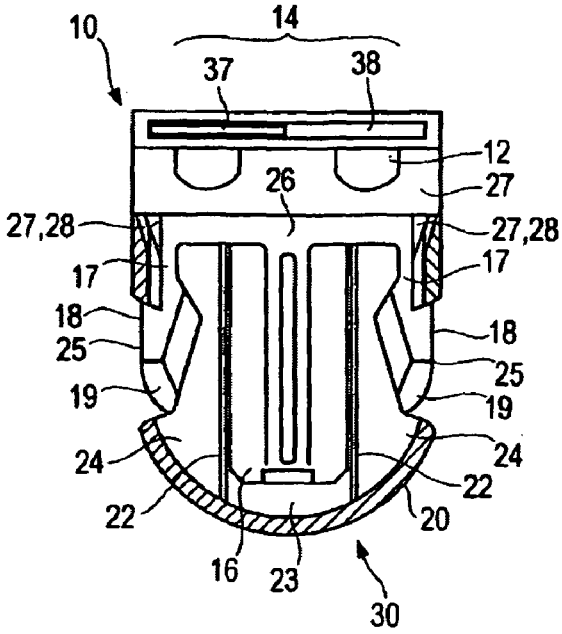
FIG. 5 is a cross sectional view of FIG. 2.
Figure 6:
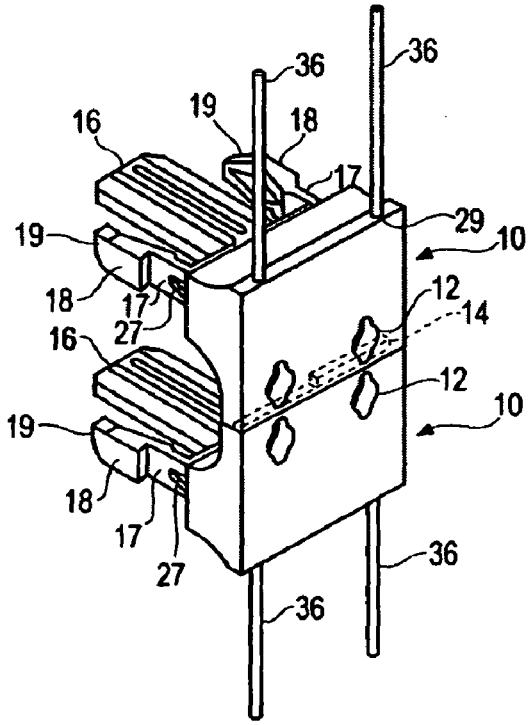
FIG. 6 shows a plurality of a tool box set fasteners secured to a plurality of wire rods fastened together according to the present invention.
Figure 7:
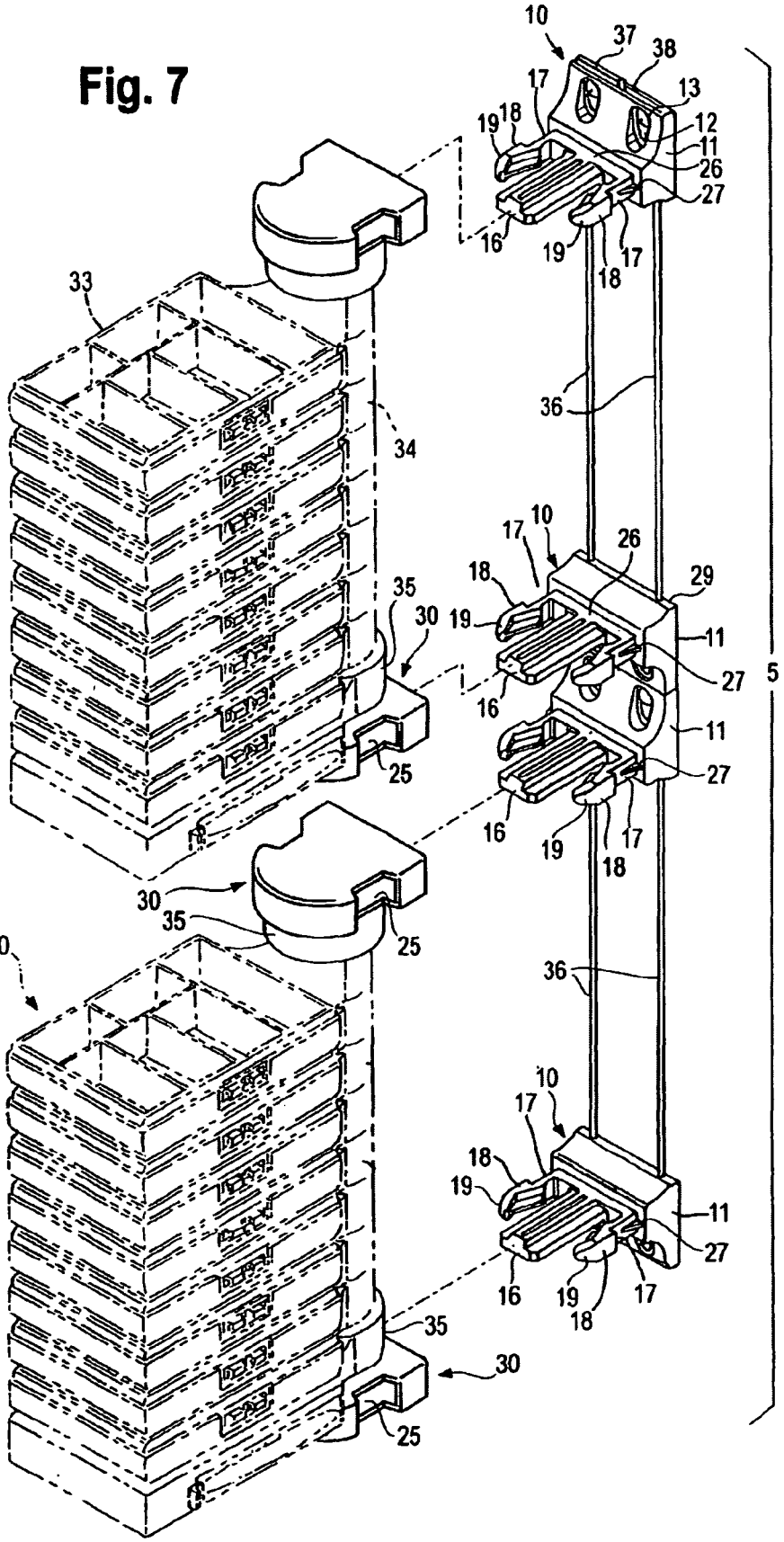
FIG. 7 illustrates two tool box sets fastened together.
Figure 8:
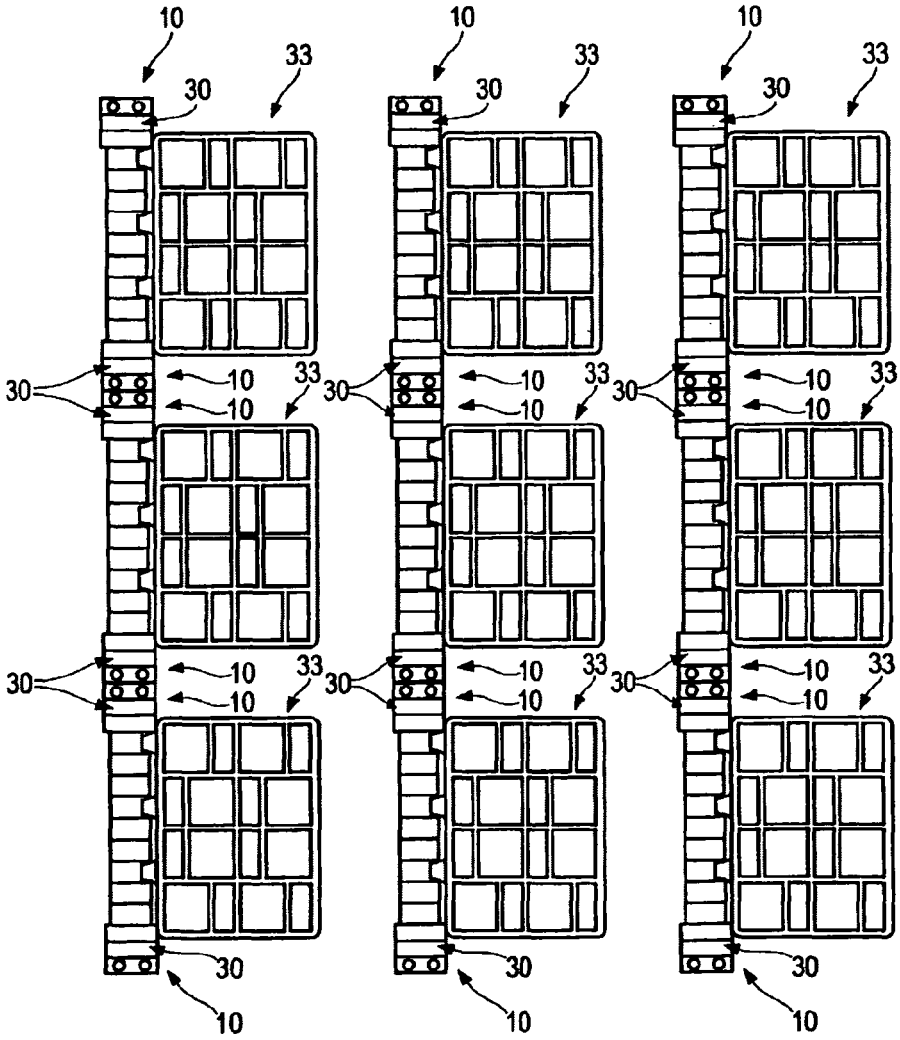
FIG. 8 is a top view of FIG. 7 of several tool box sets.

FIGS. 5 through 8 also show the back wall (26) of the coupling unit (15), a plurality of apertures (12) located in the mounting base (11), triangular retaining blocks (27) locating grooves (28) spring locking bars (17) equally spaced from the center guide shaft (26) at two sides, a front guide face (19) in front of the hooked portion (18), two locking apertures (25) of the second fastening structure (30), two side receiving chambers (24) for receiving the center guide shaft (16) and locking bars (17). A coupling base (20) is illustrated in FIGS. 5 though 8. The coupling base (20) is a hollow member having the inside space separated by partition walls (22) also illustrated as wire rods (36) and parallel apertures (29) through which the wire rods (36) are drawn. The end caps (35) and the toolbox set (33) are also illustrated in the aforementioned figures. FIG. 5 shows the toolbox fastening device (5) for fastening a toolbox set (33) to a wall.

Figure 9:
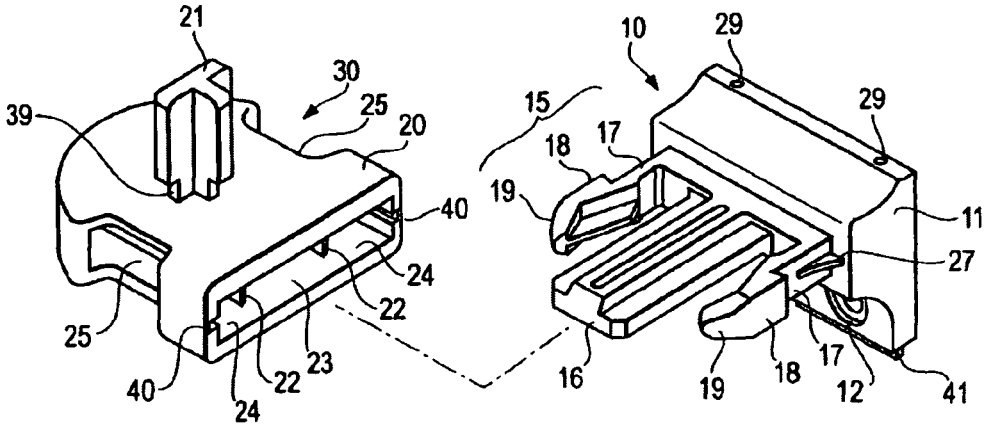
FIG. 9 is an exploded view of a first fastener and a second fastener for a tool box fastening device for fastening a tool box set to a vertical wall.
Figure 10:
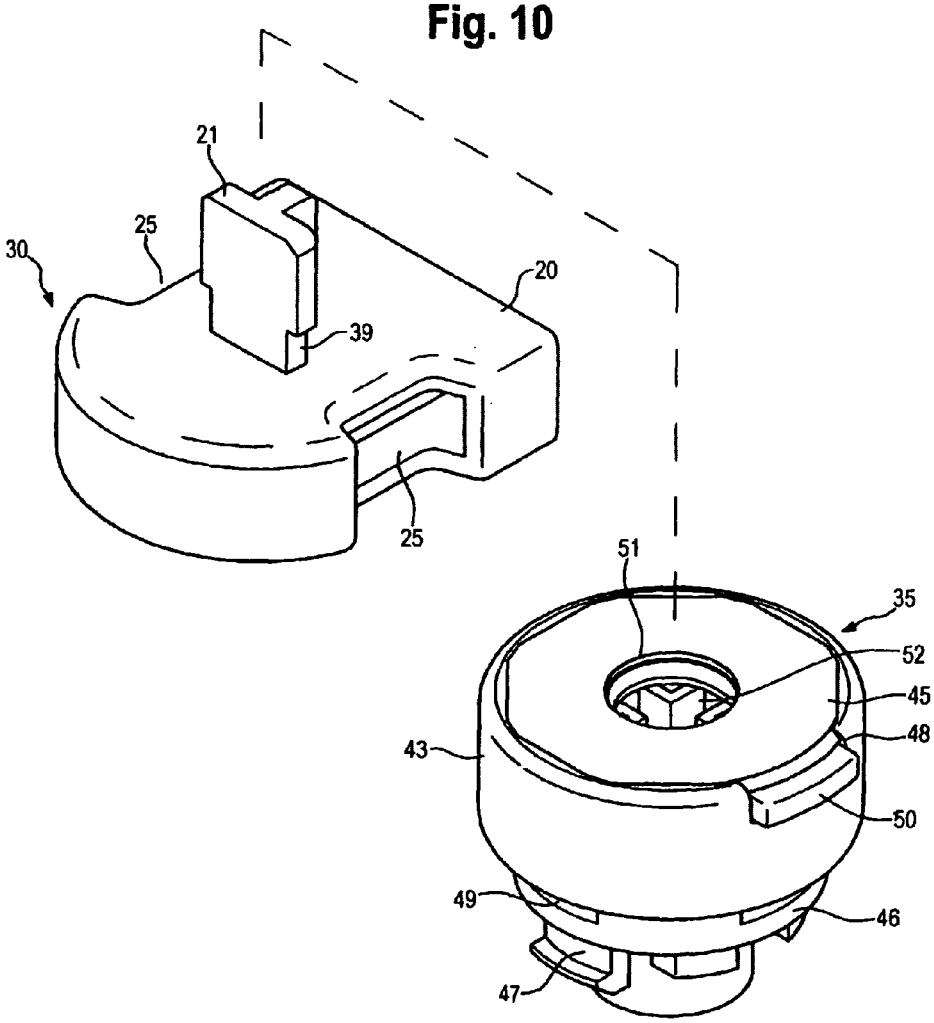
FIG. 10 is a sectional assembly view of the fist fastener and the second fastener In communication with the pivot shaft.

FIGS. 9 and 10 also illustrate the lock (39) of the plug rod (21), locating grooves (40), tongue of the mounting base (41), a pivot shaft connecting device (42), a hollow shell (43), a cover fastened to one end of the hollow shell (43), a hollow upright pivot shaft connecting device (44), a coupling ring (46), a plurality of hooks (47) extending from the coupling ring (46), an opening (48), two restraining apertures (49) formed in the coupling ring (46).

FIGS. 9 and 10 also illustrate the handle (51), two side restraining apertures (25) and a second connector (30).

FIGS. 9 and 10 illustrate that the coupling unit (15) has a solid back wall (26) formed integrally with the mounting base (11) and two triangular reinforcing blocks (27) bilaterally connected between the two distal ends of the solid back wall (26) and the mounting base (11). The coupling base (20) of the second fastening structure (30) has two locating grooves 40) adapted to receive the triangular reinforcing blocks (27), enhancing the connection stability.

FIGS. 9 and 10 illustrate the fastening structure referenced by (10) comprising a mounting base (11) for fastening to a wall, and a coupling unit (15) detachably connectable to the second fastening structure referenced by (30). The mounting base (11) has at least two mounting apertures (12) through which fastening members (13) such as screws are mounted to affix the mounting base (11) to a wall. The coupling unit (15) is formed integrally with the mounting base (11), comprising a center guide shaft (16) and two side spring locking bars (17). The side spring locking bars (17) are elastically deformable relative to the center guide shaft (16), each having an outwardly protruding front retaining block (18), which was an outer wall forming a sloping guide face (19).

The second fastening structure (30) comprises a coupling base (20) detachably connectable to the coupling unit (15) of the first fastening structure (10), a plug rod (21) detachably connectable to the hollow upright pivot shaft (34) of a toolbox set (33). The coupling base (20) comprises a plurality of partition walls (22), a center receiving chamber (23), and two side receiving chambers (24) respectively extending to the front side and arranged in parallel and separated from one another by the partition walls (22), two side locking apertures (25) of the second fastening structure, respectively disposed at two opposite lateral sides in communication with the two side receiving chambers (24) receiving the center guide shaft (16) and the locking bars (17). When connecting the first fastening structure (10) and the second fastening structure (30), the partition walls (22) guide the center guide shaft (16) and the two side spring locking bars (17) unto the center receiving chamber (23) and two side receiving chambers for receiving the center guide shaft (16) and spring locking bars (17), equally spaced from the center guide shaft (16) at two sides respectively. When inserting the spring locking bars (17) equally spaced from the center guide shaft (16) at two sides into the two side receiving chambers (24) for receiving the center guide shaft (16) and the locking bars (17) the sloping guide face (19) of the outwardly protruding front retaining block (18) of each side spring locking bars (17) is forced against the inside wall of the respective side spring locking bars (17), thereby causing the respective spring locking bars (17) to deform elastically, and therefore each side spring locking bar (17) is smoothly inserted into the respective side receiving chambers (24). After the spring locking bars (17) have been inserted into the receiving chambers (24), the side spring locking bars (17) are released from the compressive force and the outwardly protruding front hooked portion (18) of the spring locking bars (17) are respectively forced into engagement with two locking apertures (25), thereby firmly securing the second fastening structure (30) to the first fastening structure (10). When disengaging the fastening structures (see the arrowhead sign) by forcing the outwardly protruding front hooked portion (18) of the spring locking bar (17) inwards, the outwardly protruding front retaining blocks (18) are respectively disengaged from the two locking apertures (25), allowing the second fastening structure (30) to be removed from the first fastening structure (10).

Figure 11:
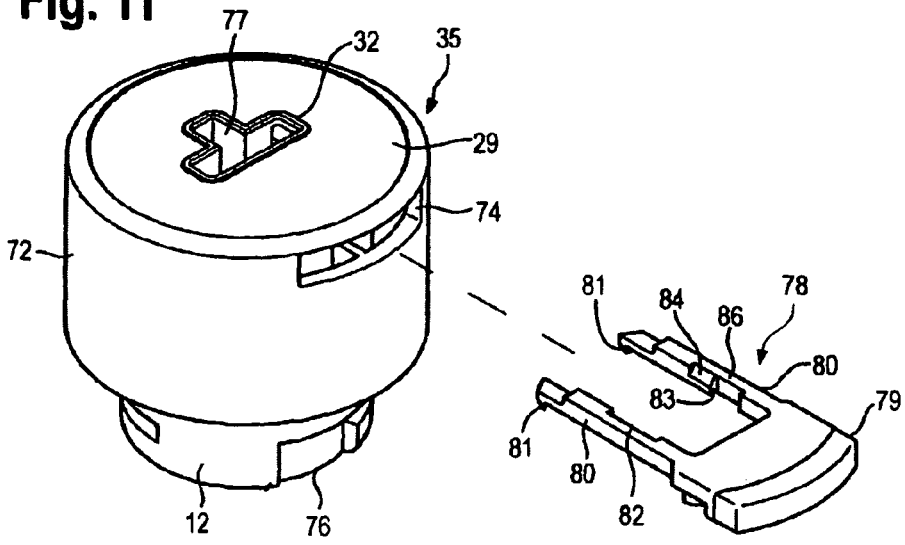
FIG. 11 is an exploded view of a pivot shaft connecting device and a locking member for the tool box set fastening device for fastening a tool box set to a vertical wall.
Figure 12:
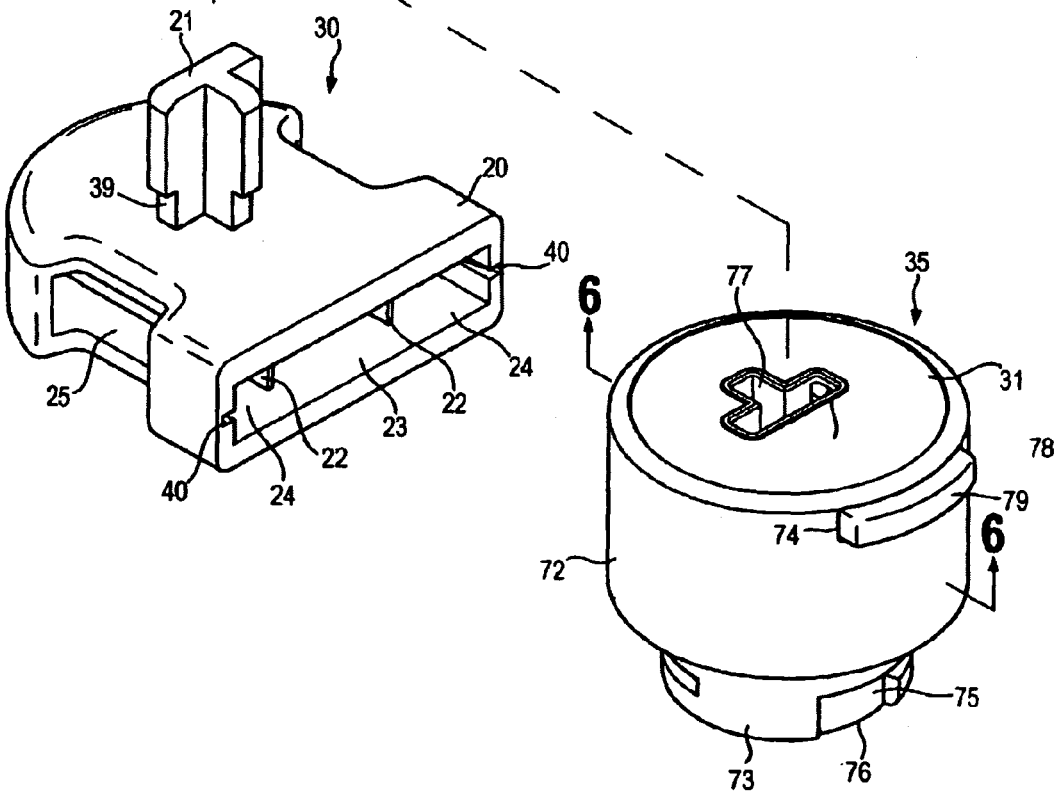
FIG. 12 illustrates the pivot shaft connecting device and the locking member assembled and the relationship between the pivot shaft connecting device and the second fastener according to the present invention.

FIGS. 11 and 12 show and end cap (35) is provided for connecting the plug rod (21) of the second fastening structure (30) to the upright hollow pivot shaft (70) of the aforesaid toolbox set (33) and a locking member (71) is inserted into the end cap (35) to lock the second connector to the end cap (35). The end cap (35) comprises a cup-like head (72), a cylindrical shank (73) formed integral with and axially downwardly extending from the transversely extending head wall (74) of the cup-like head (72). The cup-like head (72) has a transversely extending insertion aperture (74) at the periphery. The axial length of the cylindrical shank (73) is longer than the cup-like head (72) so that the cylindrical shank (73) has the lower part protruding over the bottom side of the cup-like head (72). The shank (73) has a locating groove (75) transversely disposed at the periphery, and a bottom open side (76) extending from one end of the locating groove (75) to the bottom edge. The head of the shank (73) of the end cap (35) has a T-slot (32) axially cut through the head wall (31). The peripheral wall (77) of the T-slot (32) extends to the inside of the shank (73).

The locking member (78) comprises a handle (79), and two locking rods (80) extended from the handle (79) and arranged in parallel. Each locking rod (80) has a hooked tip (81), a notch (82) longitudinally disposed on the middle at an inner side, a retaining block (83) disposed at one end of the notch near the hooked tip (81). The retaining block (83) has a beveled face (84). The locking member (71) is inserted into the insertion aperture (74) of the cup-like head (72) of the end cap (35), keeping the beveled face (84) of each locking rod (80) to the face head wall (31) of the cup-like head (72) and the handle (79) exposed to the outside of the insertion aperture (74) for operation by the user.

Figure 13:
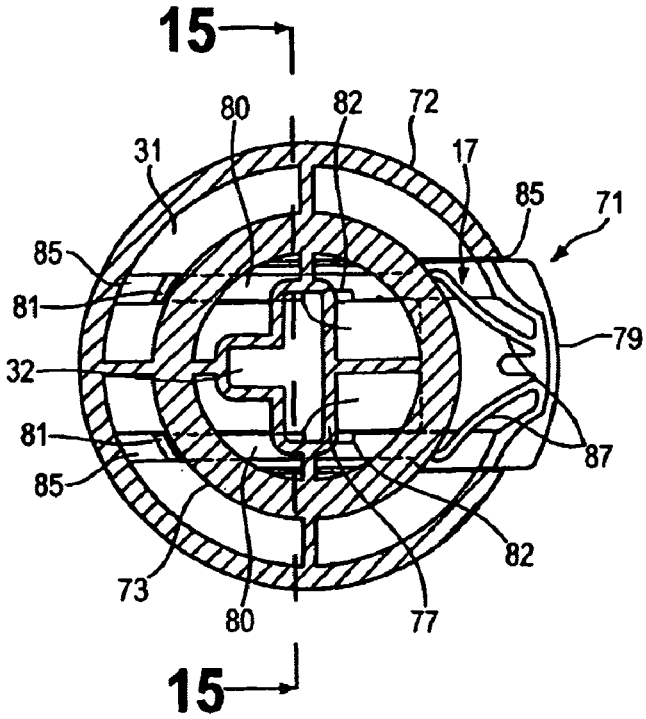
FIG. 13 is a sectional view taken along line 6-6 of FIG. 12.

FIG. 13 is a sectional view taken along line 6-6 of FIG. 12, showing the locking member (71) inserted into the insertion aperture (74) of the cup-like head (72) of the end cap (35). As illustrated, the two locking rods (80) of the locking member (71) are respectively inserted into two locating grooves (85) at the bottom side of the head wall (71) of the cup-like head (72) of the end cap (35), keeping the hooked tips (81) of the locking rods (80) respectively hooked on the peripheral wall of the cylindrical shank (73) to prohibit the locking member (71) from escaping out of the insertion aperture (83) of the end cap (35), and the notch (82) and retaining block of each of the locking rods (80) are kept in line with the T-slot (32). The locking member (71) further comprises spring locking bars (17). Two spring rods (87) obliquely symmetrically extending from the handle (79) for pressing against the periphery of the cylindrical shank (73) of the end cap (35).

Figure 14:
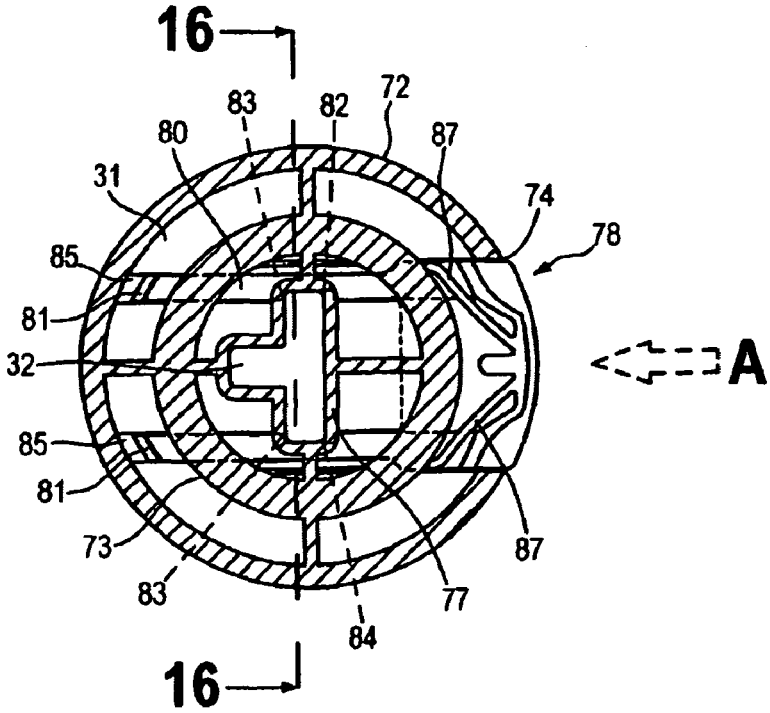
FIG. 14 corresponds to FIG. 13 showing the locking member pushed inwards relative to the pivot shaft connecting device.

FIG. 14 illustrates the situation when positioning the locking member (78) in the direction of the arrowhead sign A, the spring rods (87) are forced to deform elastically, and the retaining block (83) is moved with respect to the locking rod (80) away from the path of the T-slot for disengagement in disengagement, the spring rods (87) are released to move the locking member (71) backwards to its former position as shown in FIG. 13.

The position of the locking member (71) shown in FIG. 13 is defined to be the first position. The position of the locking member (78) shown in FIG. 14 is defined to be the second position. Therefore, the locking member (71) can be positioned horizontally between the first position and the second position.

Figure 15:
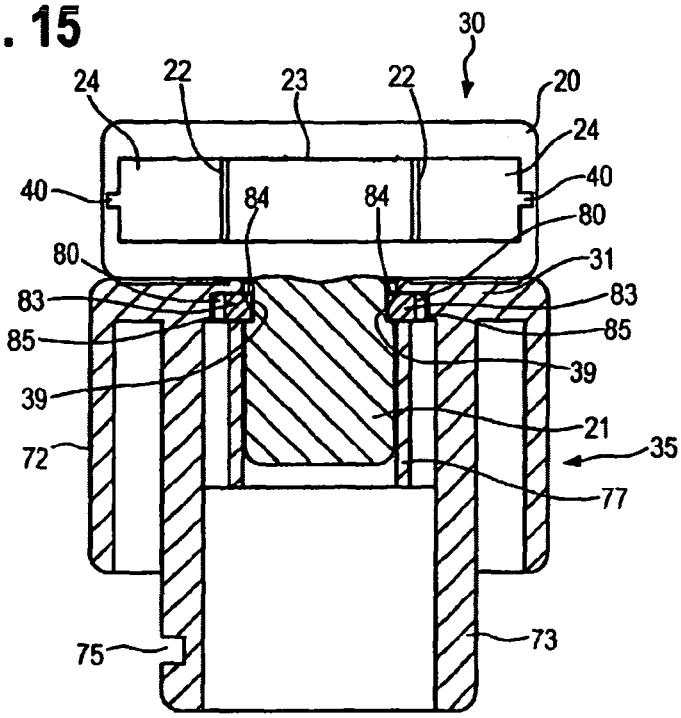
FIG. 15 is a sectional view taken along line 14-14 of FIG. 19.

FIG. 15 illustrates the adaptability of the pivot shaft connecting device (96) to receive the plug rod (21) of the second connector (30). When the locking member (99) is in the first position, the plug rod (21) can be inserted into the T-slot (96). When inserting the plug rod (21) into the T-slot (96), the plug rod (21) touches the beveled face (105) of each of the two retaining blocks (104) of the locking member (99) at first and then forces the locking member (99) to move toward the second position shown in FIG. 20 (at this time, the spring rods (108) deform elastically), the plug rod (21) can then be fully inserted into the T-slot (96). After the plug rod (21) has been fully inserted into the T-slot (96), the neck (39) is held at the elevation of the locating ring (101) and the spring rods (108) are released from the locking member (99) back so to be placed in the first position shown in FIG. 19 and therefore the retaining blocks (104) of the locking member (99) are forced into engagement with the neck (39) to lock the second connector (30).

Figure 16:
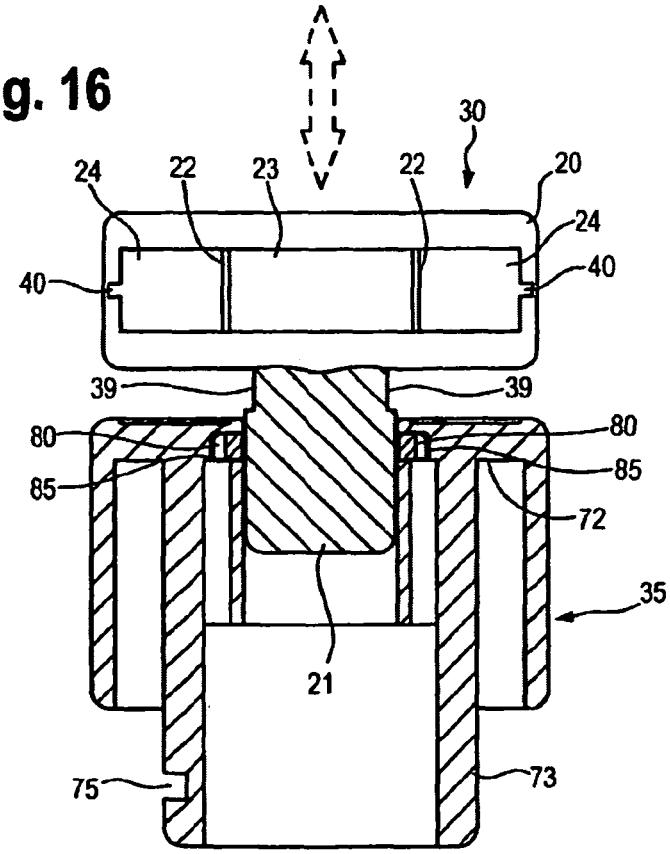
FIG. 16 corresponds to FIG. 21, showing the mounting direction of the second fastener relative to the pivot shaft connecting device.
Figure 19:
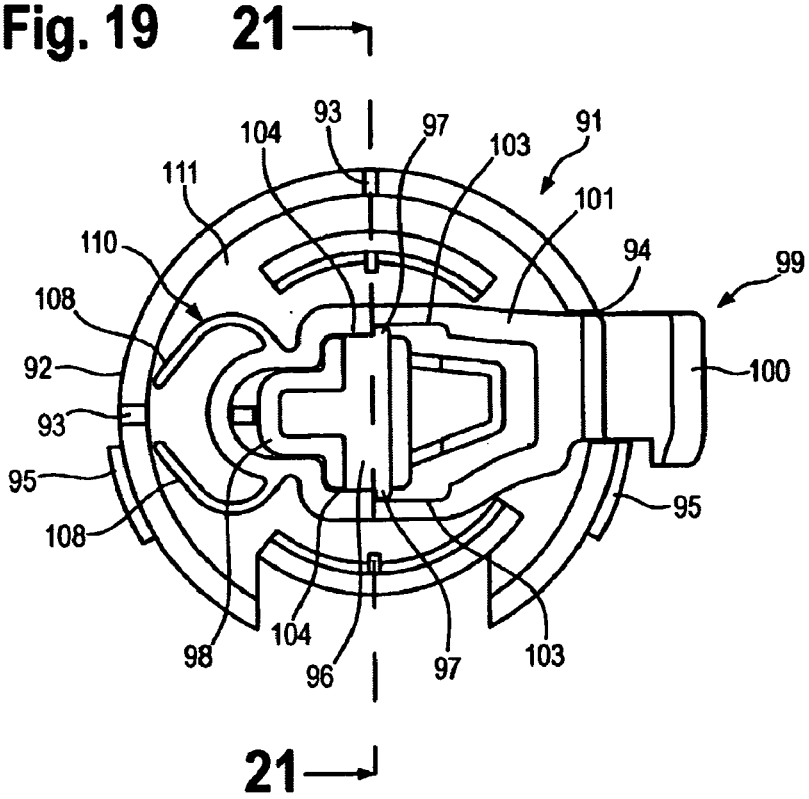
FIG. 19 is a top plain view of the assembly of the end cap and the locking member shown in FIG. 19 when viewed in direction E.
Figure 20:
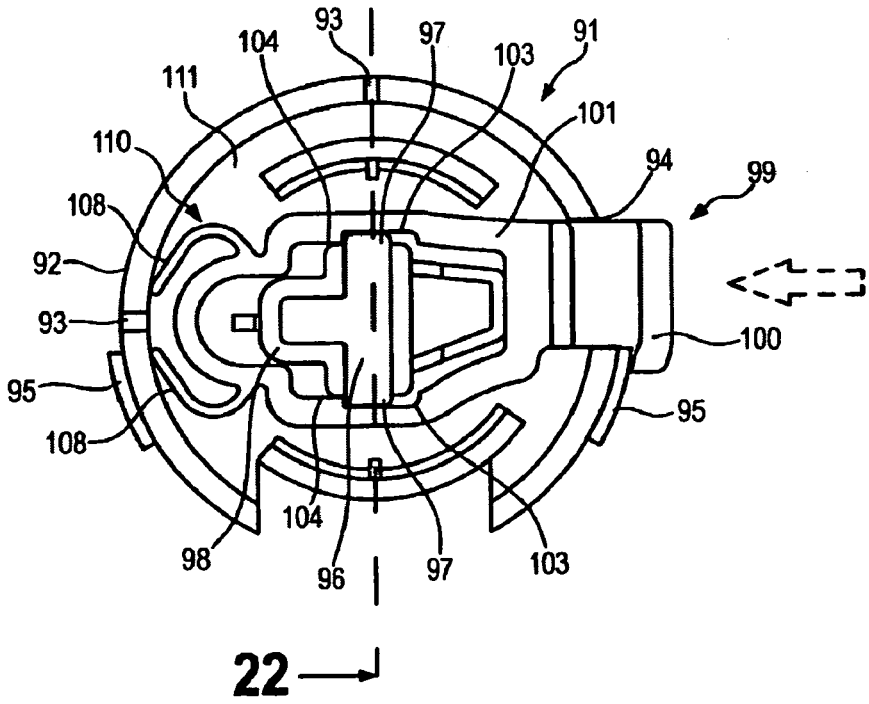
FIG. 20 corresponds to FIG. 19, showing the locking member moved in direction E.

FIG. 16 illustrates the situation when the user presses the handle (100) of the locking member (99) to move the locking member (99) from the first position shown in FIG. 19 to the second position shown in FIG. 20. The retaining blocks (104) of the locking member (99) are disengaged from the neck (39) of the plug rod (21) to unlock the second connector (30), allowing the second connector (30) to be separated from the end cap (91).

Figure 17:
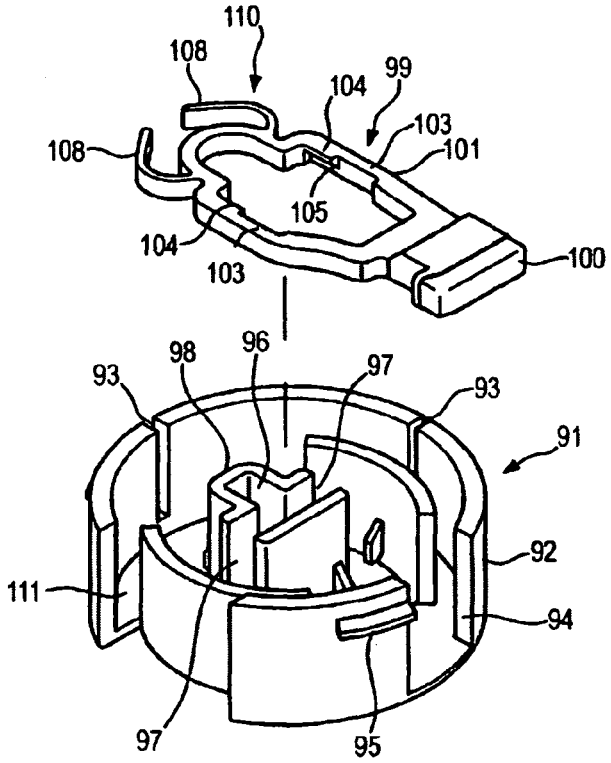
FIG. 17 is an exploded view of an alternate form of the pivot shaft connecting device and the locking member for the tool box fastening device according to the present invention.
Figure 18:
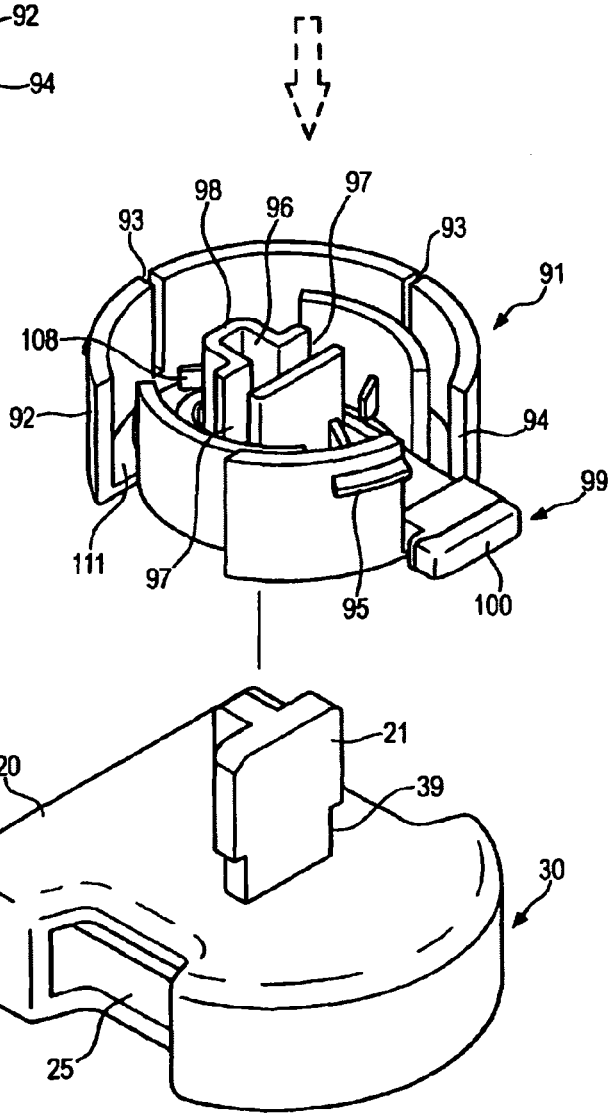
FIG. 18 is a schematic drawing showing the end cap and the locking member of FIG. 17 assembled for connection to the second fastener according to the present invention.

FIGS. 17, 18 and 19 shows an alternate form of the end cap and the locking member according to the present invention. According to this embodiment the end cap, referenced by (91) comprises a cup-like head (92), a plurality of axially extending narrow crevices (93) and an outer opening (94) at the periphery of the cup-like head (92), a retaining block (95) protruded from the periphery of the cup-like head (92) a T-lot (96) cut through the top and bottom sides of the transversely extending head wall (93) of the cup-like head (92), and inside flange (98) perpendicularly extended from the head wall 97 around the T-slot (96), and two inner openings (97) respectively formed in the inside flange at two opposite lateral sides. The locking member (99) comprises a handle (100) a locating ring (101) extending from the handle (100) and spring locking bars (103) at one end of the locating ring (101) remote from the handle (100). The locating ring (101) has two notches (103) bilaterally disposed at the inner side, and two retaining blocks (104) respectively disposed at one end of each of the notches (103) doser to the spring locking bars (101) Each retaining block (104) has a beveled face (105). According to this embodiment, the spring locking bars (101) comprises two smoothly arched spring rods (106) forwardly extending from the locating ring (102) in direction toward each other. The locating ring (102) of the locking member (99) is coupled to the inside flange (98) of the end cap (91) around the T-slot (107), keeping the notches (103) and the retaining blocks (104) suspended in the inner openings (97) and the handle (100) extended out of the outer opening (94) and the spring rods (108) stopped against the inner surface of the peripheral wall of the cup-like head (92).

FIG. 20 illustrates the situation when pushing the handle (100) to move the locking member (99) in the direction of the arrowhead sign B, the spring rods (108) are elastically deformed and the retaining blocks (104) are moved with the locating ring (101) away from the inner openings (97), keeping the T-slot (96) fully opened for the insertion of the plug rod (21) of the second connector (30). When the push disappears, the spring rods (108) immediately release the locking member (99) back and the locking member is placed in its former position as shown in FIG. 19.

The position of the locking member (99) shown in FIG. 19 is defined to be the first position. The position of the locking member (9) shown in FIG. 20 is defined to be the second position. Therefore, the locking member (99) can be positioned horizontally between the first position and the second position.

Figure 21:
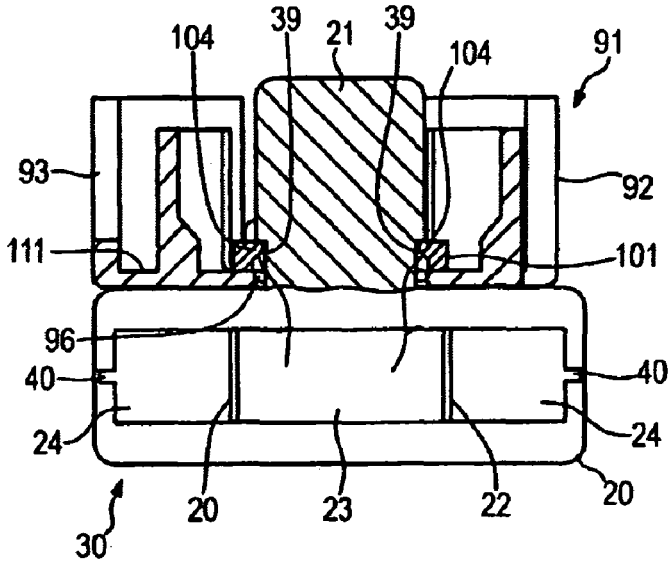
FIG. 21 is a sectional view taken along line 8-8 of FIG. 13.

FIG. 21 illustrates the T-slot (32) adaptability of the end cap (35) is adapted to receive the plug rod (21) of the second connector (30). When the locking member (71) is in the first position, the plug rod (21) can be inserted into the T-slot (32). When inserting the plug rod (21) into the T-slot (32), the plug rod (21) touched the beveled face (81) of the retaining block (83) of each locking rod (80) at first and then forces the locking member (71) to move toward the second position (at this time, the spring rods (87) are forced to deform elastically, and therefore the plug rod (21) can be fully inserted into the T-slot (32). After the plug rod (21) has been fully inserted into the T-slot (32), the neck (38) is held at the elevation of the locking rods (80), and the spring rods (87) are released from the constraint and position the locking member (71) back to the first position shown in FIG. 13, and therefore, the retaining blocks (83) of the locking rods (80) are forced into engagement with the neck (39) to lock the second connector (30) to the end cap (35).

Figure 22:
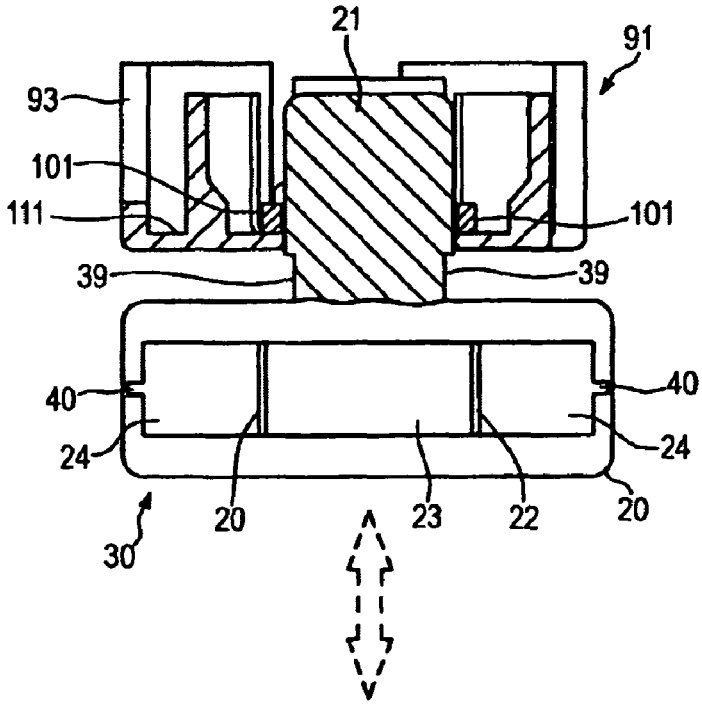
FIG. 22 corresponds to FIG. 21, showing the second fastener disengaged from the pivot shaft connecting device.

FIG. 22 illustrates the situation when the user pressed the handle (79) of the locking member (71) to move the locking member (71) from the first position shown in FIG. 13 to the second position shown in FIG. 14, the retaining blocks (83) of the locking rods (80) are disengaged form the neck (39) of the plug rod (32) to unlock the second connector (30), allowing the second of the plug rods (32) to unlock the second connector (30), allowing the second connector (30) to be separated from the end cap (35).

FIG. 15 illustrates when the user presses the handle (100) of the locking member (99) to move the locking member (99) from the first position shown in FIG. 19 to the second position shown in FIG. 20, the retaining blocks 104 of the locking member 99 are disengaged form the neck (39) of the plug rod (21) to unlock the second connector (30) allowing the second connector (30) to be separated from the end cap (91).

Figure 23:
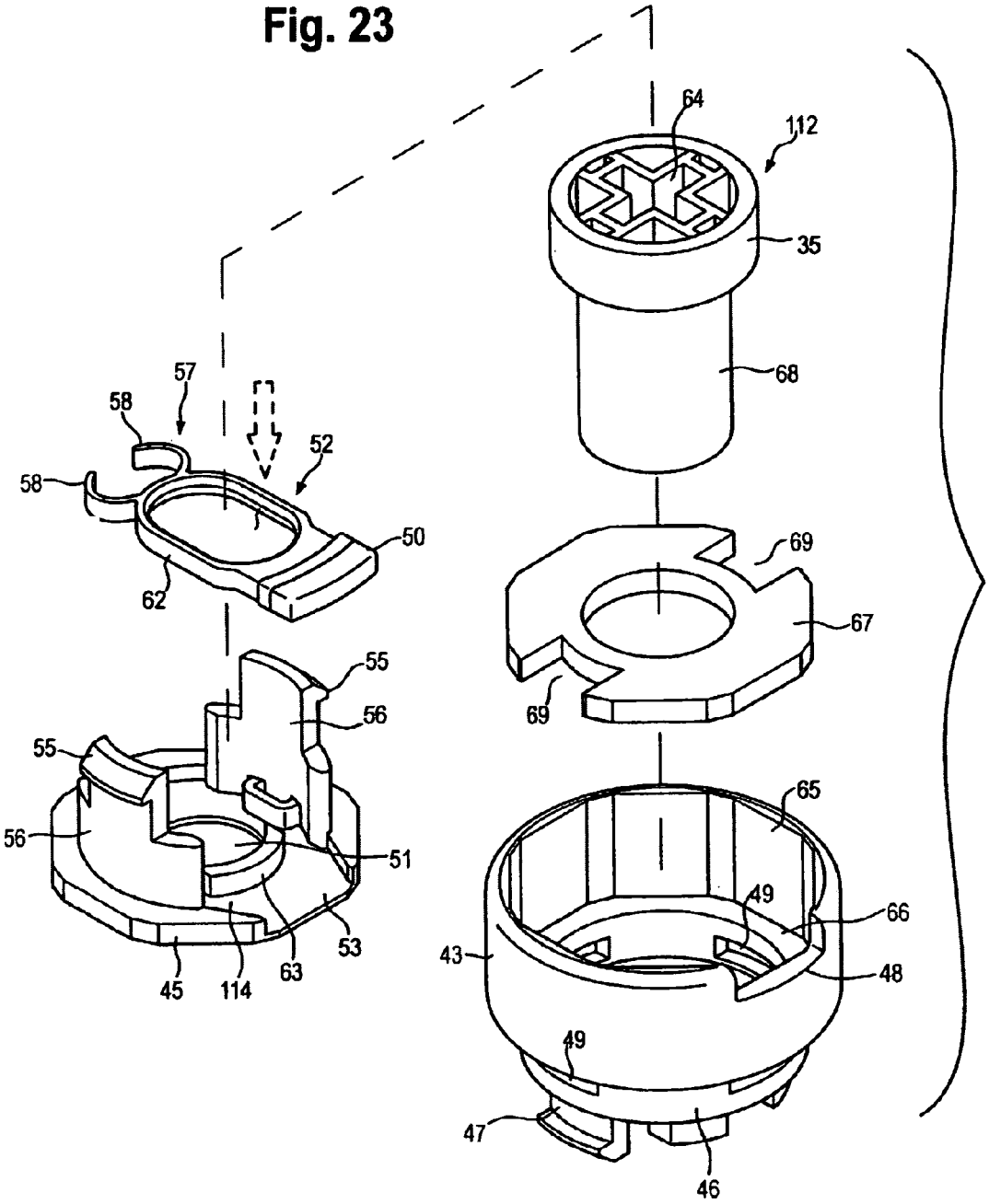
FIG. 23 is an exploded view of another alternate form of the pivot shaft connecting device and the locking member for the tool box mounting structure according to the present invention.

FIG. 23 illustrates the features of the cover (51), a receiving trough (114) disposed around the center through aperture (51) for receiving the locking member, referenced by (52), a side opening (63) at one side of the receiving trough (114), and two stop flanges, namely, the first stop flange (63) and the second stop flange (61) disposed in the receiving trough (114) around the center through hole (51).

The locking member (52) comprises a handle (50), a locating ring (62) extended from the handle (50), and spring (57) at one end of the locating ring from the handle (50). The locating ring (62) has two beveled faces (113) disposed at two opposite lateral sides and sloping downwardly inwards. The spring means (57) is comprised of two smoothly arched spring rods (58) forwardly extending from one end of the locating ring (52) remote from the handle (50) in direction toward to each other.

The locating ring (62) of the locking member (52) is coupled to the first stop flange (63) in the receiving portion (114) of the cover (45) of the end cap (35), keeping the handle (50) extended out of the side opening (53) and the spring rods (58) surrounding the second stop flange (61) and stopped against the peripheral wall (89) of the receiving trough (114).

Figure 24:
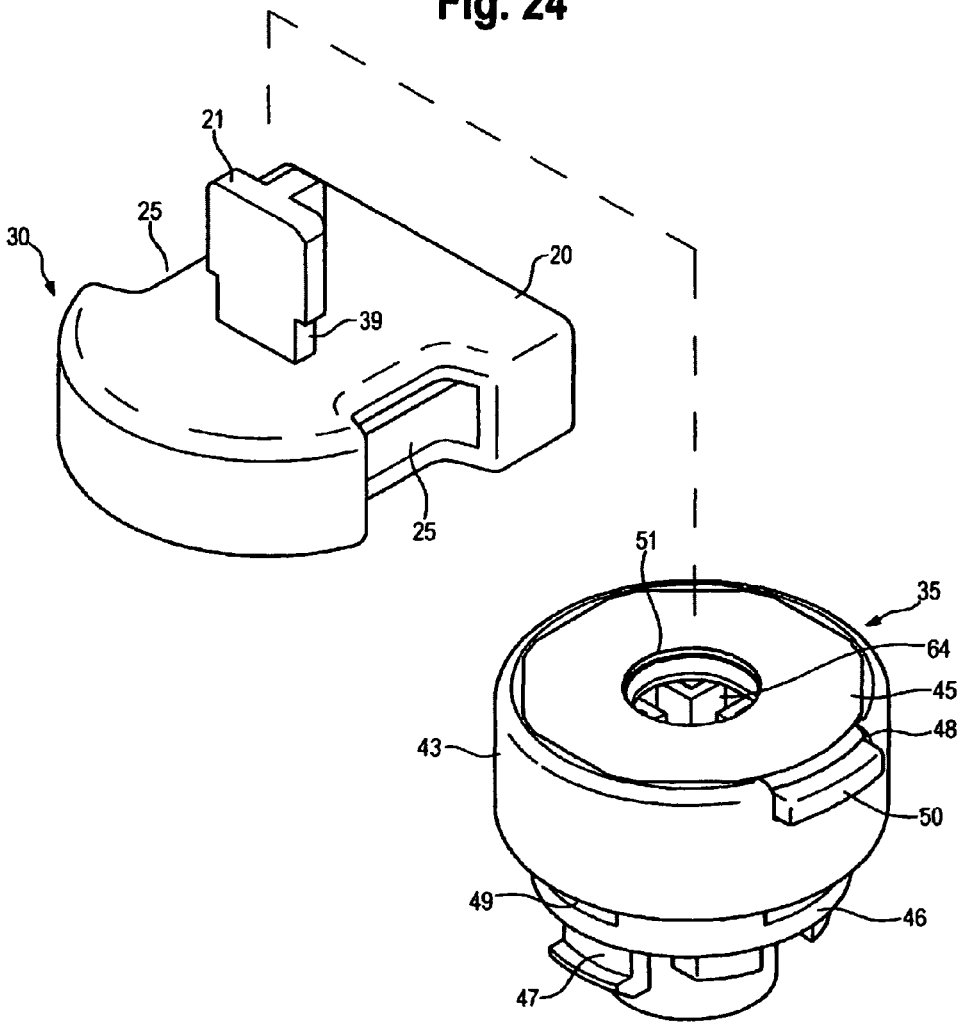
FIG. 24 is a schematic drawing showing the pivot shaft connecting device and the locking member of FIG. 23 assembled for connection to the second connector according to the present invention.

FIGS. 23 and 24 show another alternate form of the end cap and the locking member according to the present invention. According to this embodiment, the end cap, referenced by (35), comprises a hollow shell (43), a plug (112) axially mounted in and rotatable relative to the hollow shell (43) a cover (58) fastened to one end of the hollow shell (43) and a polygonal locating plate (67).

Figure 26:
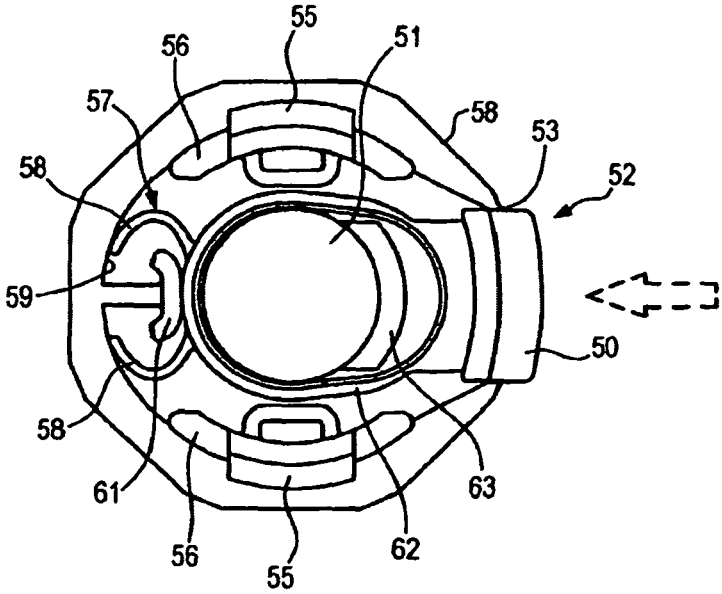
FIG. 26 corresponds to FIG. 24, showing the locking member moved in direction C.
Figure 27:
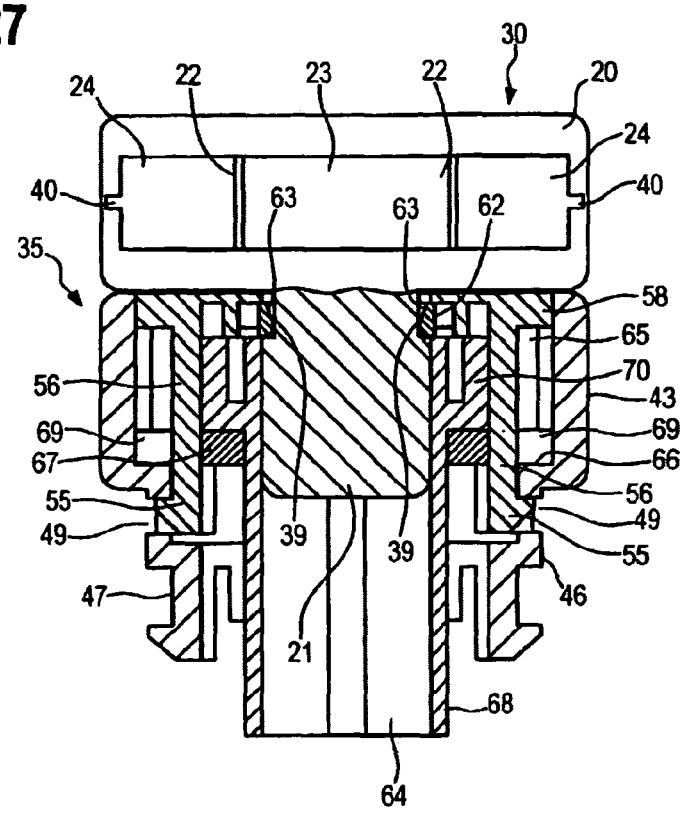
FIG. 27 is a sectional view taken along line 20-20 of FIG. 24.

Referring to FIG. 26, the hollow shell (43) has a chamber (65) of polygonal cross section, a step (66) formed in the inside wall within the chamber (65) and adapted to support the locating plate (67) in the chamber (66), a coupling ring (46) axially extending from the step (66), a plurality of hooks (47) axially extending from the coupling ring (46) opposite to the step, an opening (48) in the periphery in communication with the chamber (65) at one side, and two retaining apertures (49) formed in the coupling ride at two opposite sides.

The plug (112) is shaped like a stepped cylinder, having a head (121), a shank (68) axially extending from the head (121), and a crossed slot (64) axially extending through the head (121) and the shank (68). The head (121) has a diameter greater than the shank (68). The shank (68) of the plug (112) is inserted through the polygonal locating plate (67), keeping the head (121) of the plug (112) supported on the top surface of the polygonal locating plate (67) the polygonal locating plate (67) is fitted into the chamber (65) and supported on the step (66) in the chamber (65) having two border notches (47) symmetrically disposed at two opposite sides.

The cover (45) is fastened to the hollow shell (43) to stop the plug (112) inside the chamber (65), having two coupling plates (56). The coupling plates (56) are respectively inserted through the border notches (69) of the locating plate (67) each having a hooked portion (55) respectively hooked in the retaining apertures (49) of the hollow shell.

Figure 25:
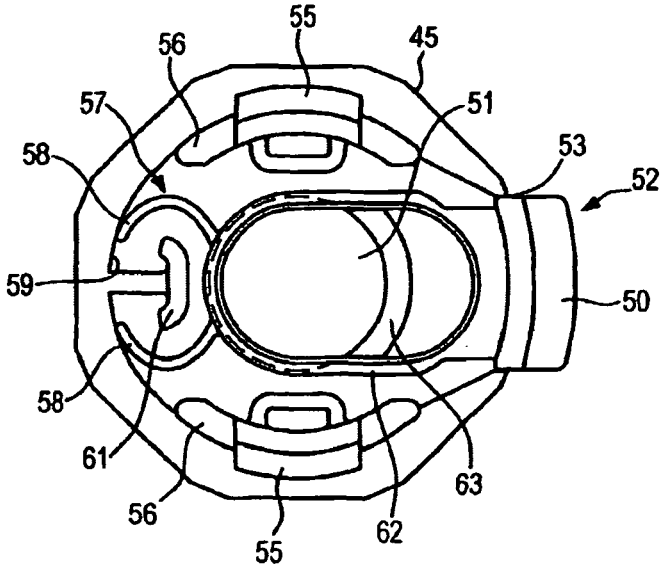
FIG. 25 is a top plain view of the assembly of the pivot shaft connecting device and the locking member shown if FIG. 24.

FIG. 26 illustrates the situation when positioning the handle (50) to move the locking member (52) in the direction of the arrowhead sign C, the spring rods (58) are elastically deformed to preserve energy, and the locating ring (62) is positioned against the second stop flange (61). When continuously pushing the locking member (45) forwards toward the inside of the end cap (35), the locating ring (62) is elastically deformed to expand outwards, the spring rods (58) are immediately released and the locking member (52) is back to its former position as shown in FIG. 25.

Figure 28:
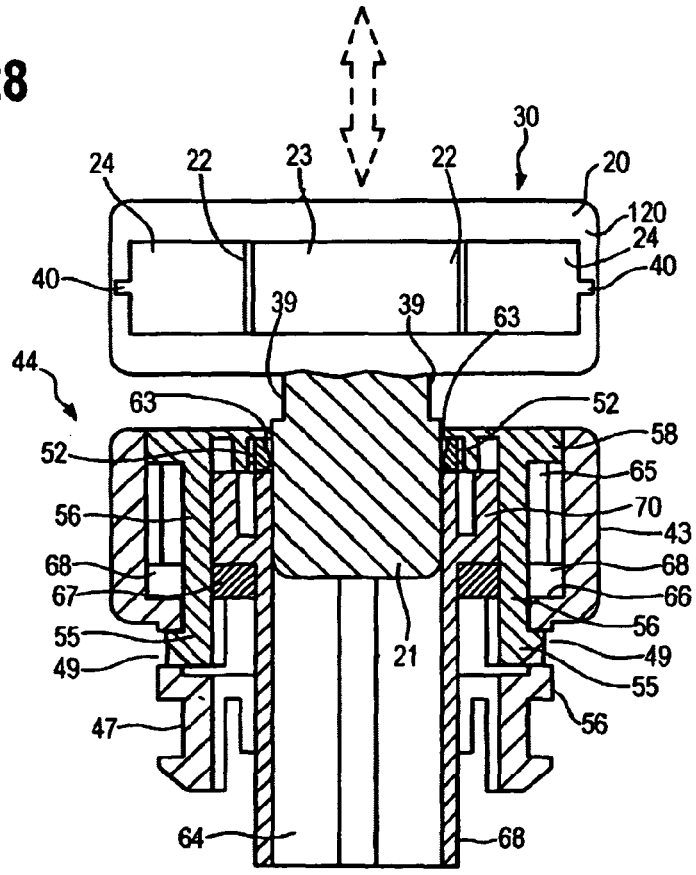
FIG. 28 corresponds to FIG. 27, showing the mounting direction of the second fastener relative to the pivot shaft connecting device.
Figure 29:
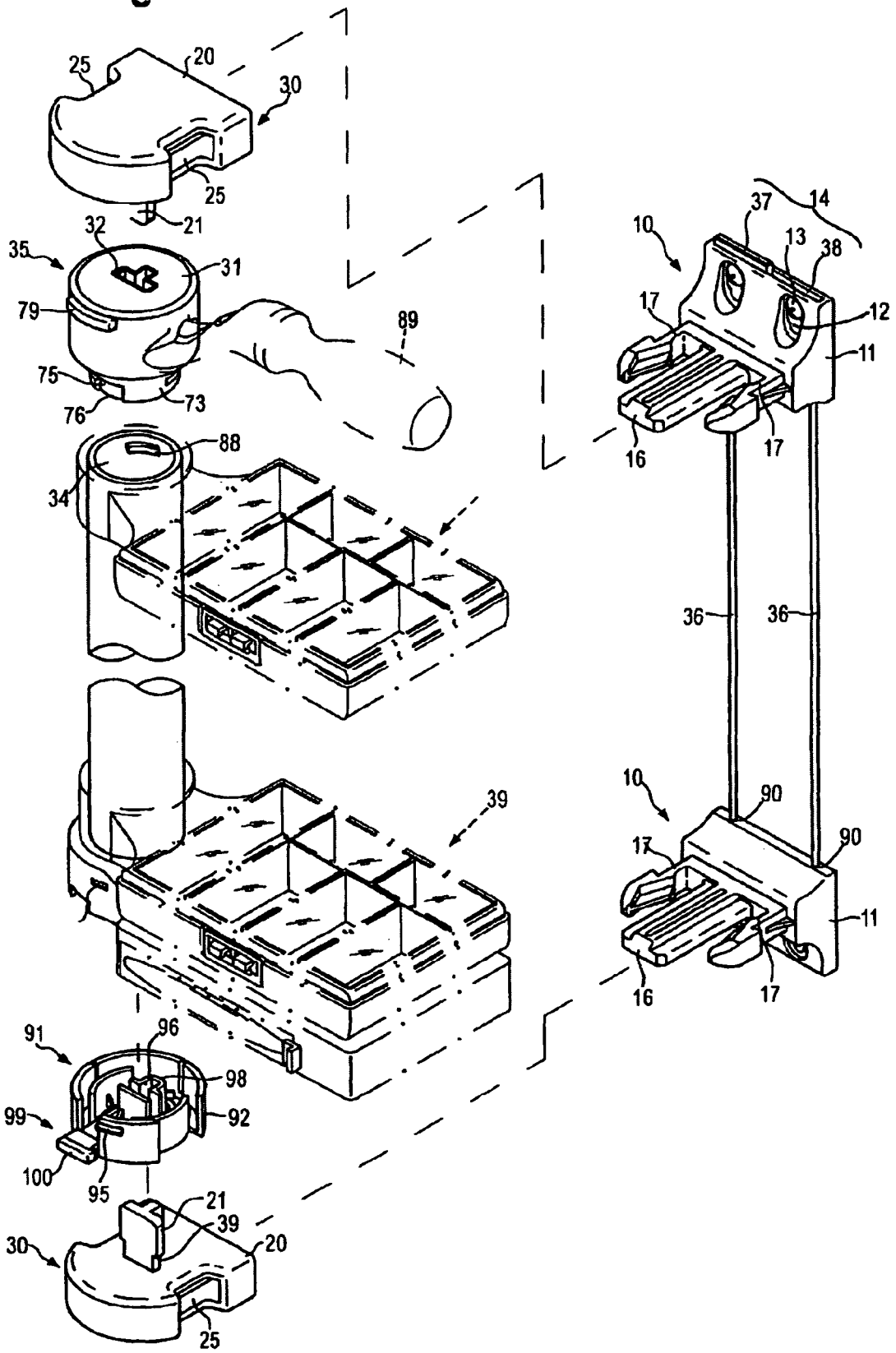
FIG. 29 is an exploded view showing an application example of the present invention.

The position of the locking member (52) shown in FIG. 28 is defined to be the first position. The position of the locking member (52) shown in FIG. 29 is defined to be the second position. Therefore, the locking member (52) can be moved horizontally between the first position and the second position.

FIG. 29 shows the cover (45) is fastened to the hollow shell (43) and covered over the chamber (65) of the hollow shell (43), the locking member (52) is supported between the plug (112) and the cove (45), and the handle (50) of the locking member (52) extends out of the opening of the hollow shell (43).

The plug rod (21) of the second connector (30) is inserted through the center through hole (51) of the cover (45) into the crossed slot (64) of the plug rod (21). When the locking member (52) is in the first position, the plug rod (21) can be inserted through the center through hole (51) of the cover into the crossed slot (64) of the plug, the plug rod (21) is moved over the beveled faces (113) of the locating ring (62) of the locking member (52) to force the locating ring (62) to expand elastically. After the plug rod (21) has been fully inserted into the crossed slot (64), the neck (39) is held at the elevation of the locating ring (62) immediately returns to its former shape and to clamp on the neck (39) of the plug rod (21), thereby securing the second connector (30) to the end cap (35) positively. As stated above, the plug (112) is rotatably mounted in the hollow shell (43), therefore, the second connector (30) can be rotated with the plug (112) relative to the hollow shell (43) and the hollow upright pivot shaft (34) of the toolbox set (33) to the desired angle.

When the user pressed the handle (50) of the locking member (52) to move the locking member (52) to the second position shown in FIG. 29, the locating ring (62) of the locking member (52) is expanded elastically and disengaged from the neck (39) of the plug rod (21) to unlock the second connector (30), allowing the second connector (30) to be separated from the end cap (35).

FIG. 29 illustrates the end cap (35) connected to one end of the hollow upright pivot shaft (34) of the toolbox set (33). The hollow upright pivot shaft (34) is a tubular shaft having a retaining block (88) protruded from the inside wall thereof near one. During installation, the cylindrical shank (73) of the end cap (35) is inserted into one end of the hollow upright pivot shaft (34), allowing the retaining block (88) to pass through the bottom open side (76) into the locating grove (75) of the shank (73), and then the end cap (35) is rotated through an angle to force the locating groove (75) into engagement with the retaining block (88), prohibiting the end cap (35) from axial movement relative to the hollow upright pivot shaft (34). On the cot, when rotating the end cap (35) through an angle relative to the hollow upright pivot shaft 934, the end cap (35) is disengaged from the retaining block (88) allowing the end cap (35) to be separated form the hollow upright pivot shaft (34). Further, the end cap (35) is fixedly provided with a carrying handle (89). After connection of the end cap (35) to the hollow upright pivot shaft (34) of the toolbox set (33), the user can carry the toolbox set (34) by hand through the carrying handle (89).

Figure 30:
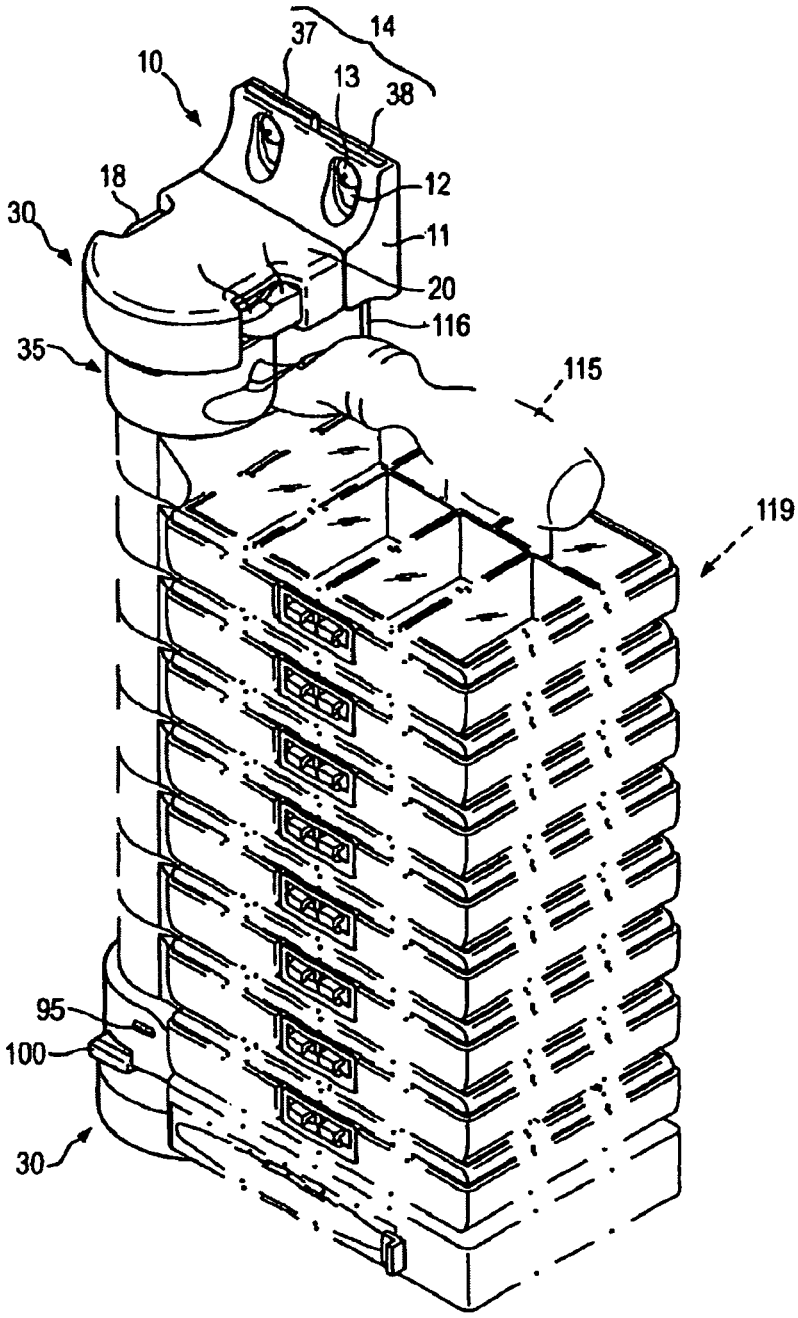
FIG. 30 is a schematic assembly view of FIG. 29.

Referring to FIGS. 29 and 30 again, two first connectors (10) are fixedly fastened to a vertical wall and vertically spaced from each other at a distance corresponding to the length of the hollow upright pivot shaft (34) of the toolbox set (33) for the connection of two second connectors (30) to secure the toolbox set (33) to the vertical wall. In order to assure the distance between the two first connectors (10) to be equal to the length of the hollow upright pivot shaft (34), the mounting base (11) of each first connector (10) is made having two mounting apertures (90) arranged in parallel at one side, and two connecting wire rods (116) that are equal to the length of the hollow upright pivot shaft (34) are respectively engaged with the respective two distal ends into the mounting apertures (90) of the mounting base (11) of each of the two first connectors (10).

Referring to FIG. 29, the end cap (91) is connected to one end of the hollow upright pivot shaft (34) of the toolbox set (33). The hollow upright pivot shaft (34) is a tubular shaft having a retaining aperture (109) at the periphery near one end. During installation, the cup-like head (92) of the end cap (91) is inserted into one end of the hollow upright pivot shaft (34) to force the retaining block (91) into engagement with the retaining aperture (109), prohibiting the end cap (91) from axial movement relative to the hollow upright pivot shaft (34).

Figure 31:
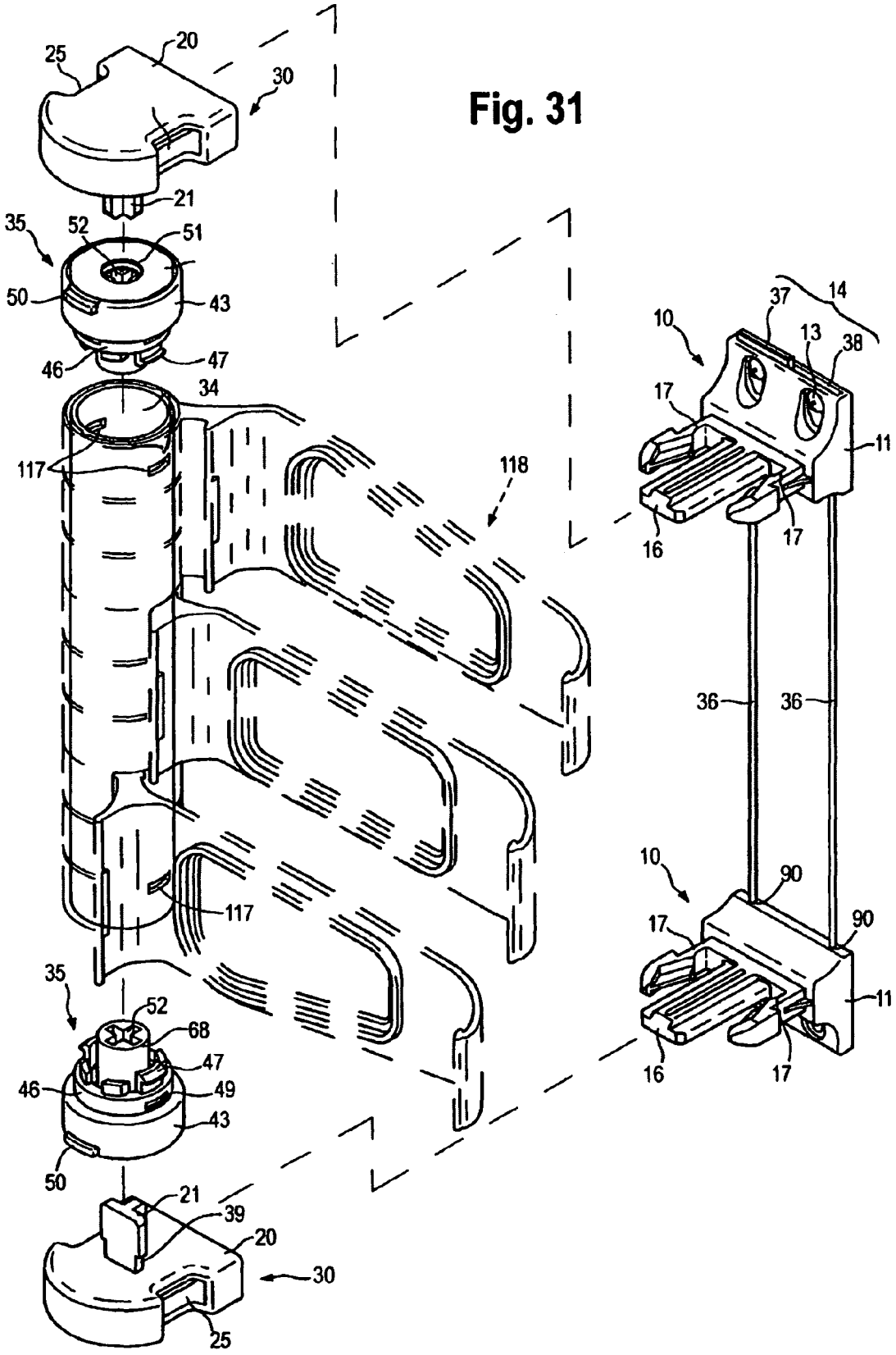
FIG. 31 is an exploded view showing another application example of the present invention.

FIG. 31 illustrates end caps (35) and locking members (71) (99) are used to connect two second connectors (30) to the two ends of the hollow upright pivot shaft (34) of a toolbox set (33) and the second connectors (30) are respectively fastened to two first connectors (10) at a vertical wall, thereby securing the toolbox set (33), the second connectors (30) are respectively disconnected from the first connectors (10) and then respectively disconnected from the end caps (35)(91) at the ends of the hollow upright pivot shaft (34) of the toolbox set (33).

The end caps (35)(91) are fastened to one end of the hollow upright pivot shaft (34) of the toolbox set (33). The hollow upright pivot shaft (34) has a plurality of retaining apertures (117) corresponding to the hooks 47) of the hollow shell (43). During installation, the coupling ring (46) of the hollow shell 943) is inserted into one end of the hallow upright pivot shaft (34) of the toolbox set (33) to force the hooks (47) into engagement with the retaining apertures (117).

Figure 32:
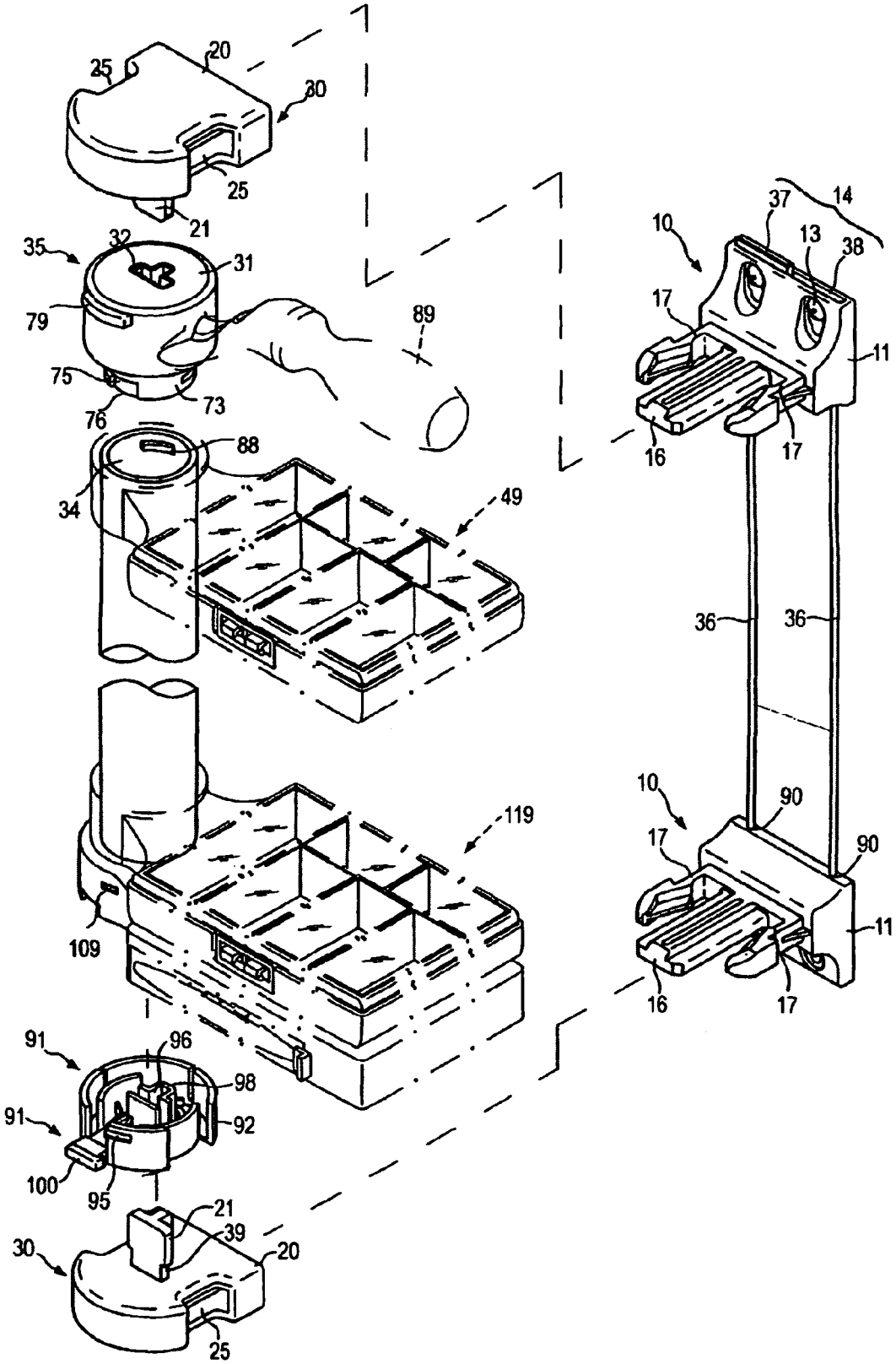
FIG. 32 is a schematic drawing showing still another application example of the present invention.

FIG. 32 illustrates the mounting base (11) of the first connector (10) has a coupling structure (14) at one side opposite to the mounting apertures (90). The coupling structure (14) comprises a tongue (37) and a groove (38). By engaging the tongue (37) of the mounting base (11) of one first connector (10), two first connectors (10) are coupled together. Further, by means of the use of two connecting wire rods (36), two first connectors are connected in pair to fit two second connectors (30) at the two ends of the hollow upright pivot shaft (34) of a toolbox set (33). Therefore, the invention allows a number of toolbox sets (33) to be fastened to a vertical wall and arranged in rows.

The invention uses locking members (79)(99) to lock the second connectors (30) to the end caps (35)(91). Therefore, when the user uses two hands to connect the second connectors (30) to the first connectors (10) at a vertical wall or to disconnect the second connectors (30) from the first connectors (10) in order to remove the toolbox set (33) from the vertical wall, the toolbox set (33) is maintained connected to the second connectors (30) positively and will not fall form the second connectors (30) to the ground.

Various modifications to the invention are contemplated. It is understood therefore, that within the scope of the appended claim, the invention may be produced otherwise than specifically described herein.

What is claimed is:

1. A tool box fastening device for fastening a toolbox set to a wall or upright support, comprising:

a first fastening structure, said first fastening structure comprising a mounting base fastened to an upright support, and a coupling unit;

a second fastening structure attachable to a toolbox set for securing the toolbox to said first fastening structure, said second fastening structure comprising a coupling base connectable to the coupling unit of said first fastening structure; and said coupling unit of said first fastening structure comprising a center shaft and a plurality of locking bars, equally spaced from the center shaft at two sides and wherein each locking bar of said first fastening structure comprises a front hooked portion, said front hooked portion having a front guide face sloping forwardly inwards toward said center guide shaft, wherein the coupling base of the second fastening structure includes a plug rod and the toolbox set comprises an upright pivot shaft having two end caps, wherein each end cap has a plughole for receiving the plug rod.

2. The toolbox fastening device for fastening a toolbox to a wall of claim 1, wherein the coupling base of said second fastening structure is a hollow member having a plurality of partition walls, a center receiving chamber for receiving said center shaft, and two side receiving chambers separated from said center receiving chamber at two sides by said partition walls for receiving said locking bars.

3. The toolbox fastening device for fastening a tool box set to a wall of claim 1, wherein said center shaft and said locking bars of said coupling unit of said first fastening structure each have a rear end respectively terminating at a back wall of said coupling unit the back wall of said coupling unit is formed integrally with a front wall of said mounting base.

4. The tool box fastening device for fastening a tool box set to a wall of claim 3, wherein said first fastening structure comprises a plurality of reinforcing blocks bilaterally connected between the back wall of said coupling unit and the front wall of said mounting base, wherein the coupling base of said second fastening structure has a plurality of locating grooves respectively formed in said side receiving chambers for receiving said reinforcing blocks of said first fastening structure.

5. The toolbox fastening device for fastening a toolbox set to a wall of claim 1, wherein said mounting base of said first fastening structure comprises two mounting apertures for fastening to said upright support with fasteners.

6. The toolbox fastening device for fastening a toolbox set to a wall of claim 1, wherein said mounting base of said first fastening structure comprises a coupling structure for enabling a plurality of mounting bases of the first fastening structure to be fastened together.

7. The toolbox fastening device for fastening a toolbox set to a wall of claim 6, wherein said coupling structure comprises a tenon and a mortise.

8. The toolbox fastening device for fastening a toolbox set to a wall of claim 1, wherein said mounting base of said first fastening structure has at least one aperture respectively mounted with a wire rod.

9. A toolbox fastening device for fastening a toolbox set to a wall or upright support, comprising:

a first fastening structure, said first fastening structure comprising a mounting base fastened to an upright support, and a coupling unit;

a second fastening structure attachable to a toolbox set for securing the toolbox to said first fastening structure, said second fastening structure comprising a coupling base connectable to the coupling unit of said first fastening structure; and said coupling unit of said first fastening structure comprising a center shaft and a plurality of locking bars, wherein each locking bar of said first fastening structure comprises a front hooked portion, wherein the coupling base of said second fastening structure is a hollow member having two side receiving chambers and has two locking apertures forming a plurality of opposite lateral sidewalls in communication with said side receiving chambers for engagement with the front hooked portions of said locking bars respectively, wherein the coupling base of the second fastening structure includes a plug rod and the toolbox set comprises an upright pivot shaft having two end caps, wherein each end cap has a plughole for receiving the plug rod.

* * * * *